US008474075B2

(12) United States Patent
Kawakami et al.

(10) Patent No.: US 8,474,075 B2
(45) Date of Patent: Jul. 2, 2013

(54) BED

(75) Inventors: Hideo Kawakami, Osaka (JP); Yohei Kume, Osaka (JP); Tohru Nakamura, Osaka (JP); Mizuho Sakakibara, Tokyo (JP); Toshihide Ueda, Osaka (JP)

(73) Assignee: Panasonic Corporation, Osaka (JP)

( * ) Notice: Subject to any disclaimer, the term of this patent is extended or adjusted under 35 U.S.C. 154(b) by 374 days.

(21) Appl. No.: 12/937,583

(22) PCT Filed: Mar. 19, 2010

(86) PCT No.: PCT/JP2010/001979

§ 371 (c)(1),
(2), (4) Date: Oct. 13, 2010

(87) PCT Pub. No.: WO2010/113413

PCT Pub. Date: Oct. 7, 2010

(65) Prior Publication Data

US 2011/0030138 A1 Feb. 10, 2011

(30) Foreign Application Priority Data

Mar. 31, 2009 (JP) ..... 2009-084549

(51) Int. Cl.

| | |
|---|---|
| ***A61G 7/16*** | (2006.01) |
| ***A61G 1/017*** | (2006.01) |
| ***A47C 17/17*** | (2006.01) |
| ***A47C 17/18*** | (2006.01) |

(52) U.S. Cl.
USPC ..... 5/618; 5/600; 5/86.1; 5/81.1 R

(58) Field of Classification Search
USPC ..... 5/613, 617, 618, 612, 600, 86.1, 5/81.1 R, 424, 425, 428, 430; 280/250.1; 297/DIG. 4
See application file for complete search history.

(56) References Cited

U.S. PATENT DOCUMENTS 2,587,068 A * 2/1952 Sanders ..... 5/86.1
2,607,929 A * 8/1952 Balluff ..... 5/618

(Continued)

FOREIGN PATENT DOCUMENTS

CN 2479817 Y 3/2002
JP 5-51330 7/1993

(Continued)

OTHER PUBLICATIONS

International Preliminary Report on Patentability & Written Opinion of the International Searching Authority (in English) issued Nov. 15, 2011 in International Application No. PCT/JP2010/001979.

(Continued)

*Primary Examiner* — Robert G Santos
(74) *Attorney, Agent, or Firm* — Wenderoth, Lind & Ponack, L.L.P.

(57) ABSTRACT

A movable bed of the present invention, which includes a mat portion of a bed to lie thereon, and is composed of a fixed portion and a moving portion, is designed as a wheel chair in such a manner that the moving portion can be separated from or joined to the fixed portion and be transformed from a lying posture state to a sitting posture state, and when the moving portion is joined to the fixed portion so as to form the movable bed, an upper surface of a resting portion, allowing a person to carry thereon, of the moving portion and an inner surface of an armrest portion are configured to form a mat surface of the mat portion of the movable bed.

13 Claims, 14 Drawing Sheets

U.S. PATENT DOCUMENTS

| | | | | | |
|---|---|---|---|---|---|
| 3,284,126 | A | * | 11/1966 | Piazza | 296/20 |
| 3,936,893 | A | * | 2/1976 | Anderson et al. | 5/86.1 |
| 4,119,342 | A | * | 10/1978 | Jones | 297/80 |
| 4,974,905 | A | * | 12/1990 | Davis | 297/377 |
| 4,987,620 | A | * | 1/1991 | Sharon | 5/600 |
| 5,896,602 | A | * | 4/1999 | Marblestone | 5/81.1 R |
| 6,272,702 | B1 | * | 8/2001 | Uchida et al. | 5/600 |
| D464,004 | S | * | 10/2002 | Noshi | D12/128 |
| 6,584,629 | B2 | * | 7/2003 | Tsuji et al. | 5/618 |
| 6,792,633 | B1 | * | 9/2004 | Ito | 5/618 |
| 7,003,830 | B2 | * | 2/2006 | Ito | 5/621 |
| 7,182,404 | B2 | * | 2/2007 | Laurent | 297/411.39 |
| D644,850 | S | * | 9/2011 | Sakakibara et al. | D6/383 |
| D645,273 | S | * | 9/2011 | Sakakibara et al. | D6/383 |
| D645,674 | S | * | 9/2011 | Sakakibara et al. | D6/383 |
| 2001/0029629 | A1 | * | 10/2001 | Tsuji et al. | 5/618 |
| 2004/0004383 | A1 | * | 1/2004 | Laurent | 297/354.13 |
| 2004/0205895 | A1 | * | 10/2004 | Ito | 5/618 |
| 2011/0030138 | A1 | * | 2/2011 | Kawakami et al. | 5/2.1 |
| 2011/0196562 | A1 | * | 8/2011 | Kume et al. | 701/23 |
| 2012/0169093 | A1 | * | 7/2012 | Kume et al. | 297/118 |

FOREIGN PATENT DOCUMENTS

| | | |
|---|---|---|
| JP | 2001-293041 | 10/2001 |
| JP | 2008-295879 | 12/2008 |

OTHER PUBLICATIONS

International Search Report issued May 11, 2010 in International (PCT) Application No. PCT/JP2010/001979.

* cited by examiner

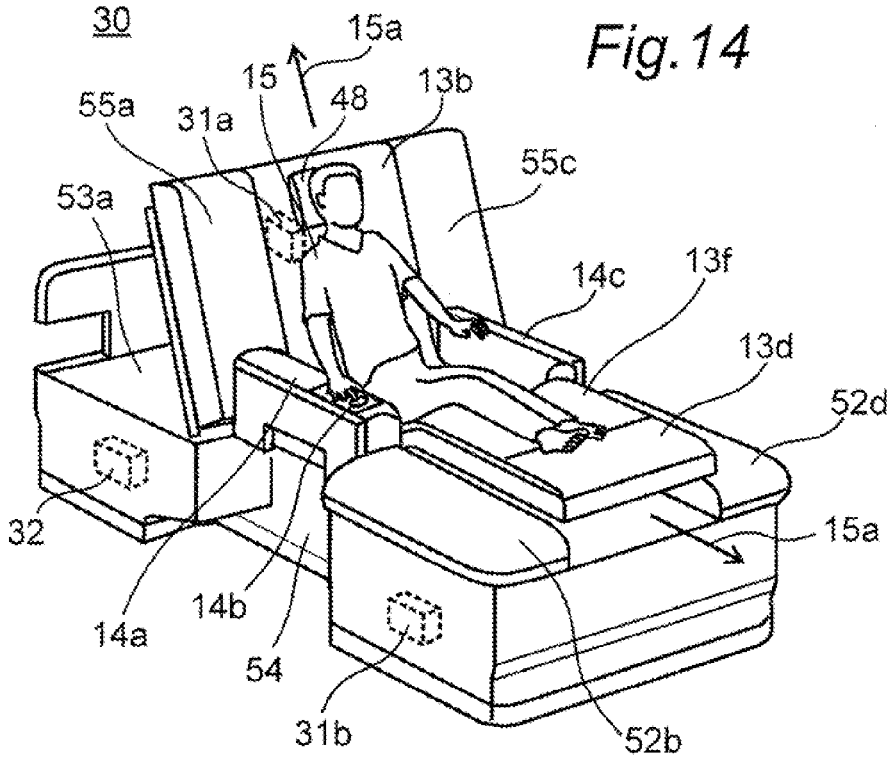
Fig. 14
Fig. 15A
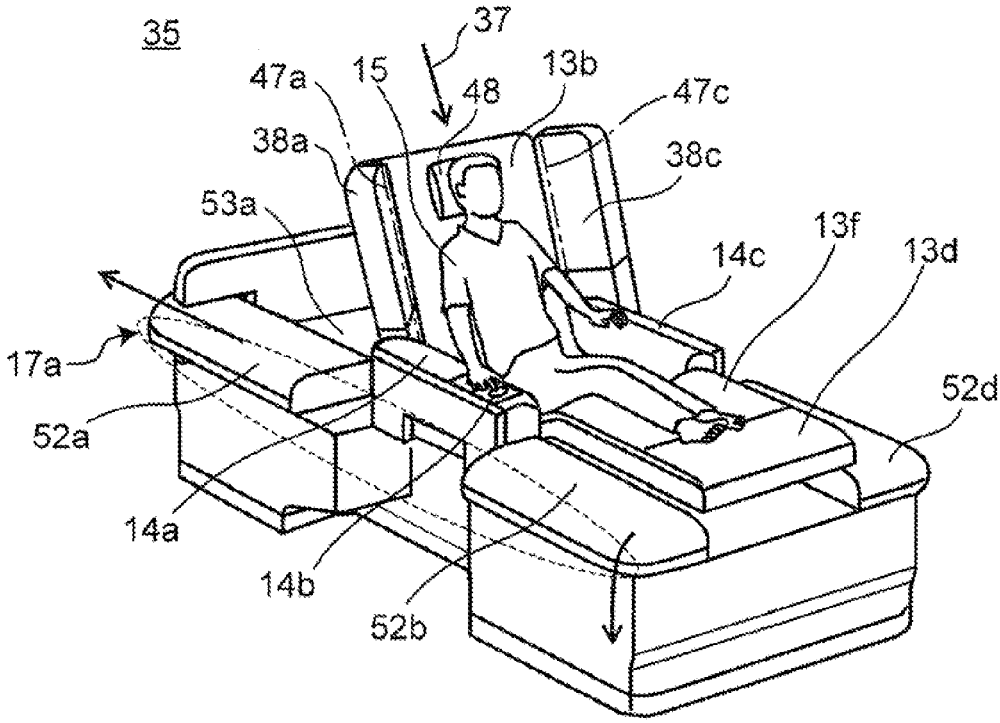

BED

TECHNICAL FIELD

The present invention relates to a bed in which a part of a mat portion of the bed is separated to be utilized also as a wheel chair.

BACKGROUND ART

In a hospital or a caring facility, it is necessary to move a patient, a cared person, or the like (hereinafter, referred to as a "cared person" or the like) from a state lying on a bed in a hospital room to another place many times in one day. In this case, upon transferring the patient, the cared person, or the like, from the bed onto, for example, a wheel chair, normally, this job is manually carried out by a nurse, a care giver, or the like, with a result that much physical load is imposed on the nurse, the care giver, or the like.

In order to reduce such physical load and also lighten such a transferring job, a bed has been proposed in which a part of a mat portion of a bed is separated and is utilized also as a wheel chair (for example, see Japanese Unexamined Utility Model Publication No. 5-51330).

FIG. 17 is a perspective view that shows a schematic structure of a bed apparatus according to Japanese Unexamined Utility Model Publication No. 5-51330. The bed apparatus of Japanese Unexamined Utility Model Publication No. 5-51330 has a structure in which a mat plate forming a mat portion of the bed is divided into three portions in a width direction of a bed main body 1, and a center mat plate 2 located in the center of the mat plate is separated from the bed main body 1 together with a cart 3 so as to be utilized also as a transferring wheel chair. Upon separating and taking out the center mat plate 2 from the bed main body 1 together with the cart 3, a side mat plate 4 on one side of the paired side mat plates 4 that sandwich the center mat plate 2 is moved upward from the bed main body 1 by a rotation mechanism 5 installed in the bed main body 1, so that this movement allows the side mat plate 4 to retreat.

With this structure, by simply taking and putting the cart 3 out of and into the bed main body 1 with the side mat plate 4 on one side being raised, the center mat plate 2 can be separated from the bed main body 1 and returned to its original position. Therefore, this structure makes it possible to easily carry out jobs of separating the portion forming a wheel chair from the bed main body 1 and joining the portion to the bed main body 1 swiftly, with a cared person or the like being carried thereon.

In the conventional art described above, however, when the center mat plate 2 and the cart 3 are separated as a wheel chair (or joined to the bed main body), the side mat plate 4 is moved upward to retreat from the bed main body 1. For this reason, issues arise in which, upon or after retreating, a person lying on the bed or the wheel chair receives an oppressive feeling by the retreating side mat plate 4, and in which in a case where the retreating is insufficient, there may be a risk of collision of the person with the side mat plate 4.

Moreover, in most cases, the caring or hospital-use bed is required for providing a back-raised or leg-raised posture state; however, since the above-mentioned conventional bed is not provided by taking the back-raised and leg-raised posture states into consideration, much load is sometimes applied to the cared person or the like, resulting in an issue in which functions as the caring or hospital-use bed are not sufficiently satisfied.

SUMMARY OF THE INVENTION

The present invention has been configured to resolve the above-mentioned issues, and an object thereof is to provide a bed that allows a cared person or the like to comfortably lie thereon, and also to move on a wheel chair safely and comfortably.

In order to achieve the above-mentioned object, the present invention has the following structures:

According to a first aspect of the present invention, there is provided a movable bed comprising:

a fixed portion; and a moving portion that is separably joined to the fixed portion, the fixed portion and the moving portion being formed into a mat portion on which a person lies, wherein the moving portion is constructed as a wheel chair having a seat portion and an armrest portion placed on one side of the seat portion so as to be pivotable between an upright posture state and a sideway lying posture state;

in a state where the moving portion is joined to the fixed portion, the armrest portion of the moving portion is pivoted to the sideway lying posture state so that an upper surface of the seat portion and an upper surface of the armrest portion are formed into a mat surface of the mat portion; and in a state where the moving portion is separated from the fixed portion, the armrest portion of the moving portion is pivoted to the upright posture state so that the armrest portion forms an armrest of the wheel chair.

According to a second aspect of the present invention, there is provided the movable bed according to the firth aspect, wherein the seat portion of the moving portion is formed by coupling a plurality of divided portions including at least a back resting portion, a hip resting portion, and a leg resting portion, to each other so as to be freely bent with respect to each other, so that, by bending the divided portions with respect to each other or by releasing bending of the divided portions with respect to each other, at least one of posture states including a lying posture state, a sitting posture state, and a leg raised posture state is formed, with the armrest portion being placed on the side of the hip resting portion so as to be pivotable.

According to a third aspect of the present invention, there is provided the movable bed according to the first or second aspect, wherein the moving portion is separably joined to a concave portion of the fixed portion, a plurality of movable mat portions are placed on at least one side of the concave portion of the fixed portion, and at least one of the plurality of movable mat portions is placed at a bed formation position to form a mat surface of the mat portion when the seat portion of the moving portion is brought into the lying posture state, while, when the moving portion is separated from or joined to the fixed portion, the movable mat portion is placed at a retreated position.

According to a fourth aspect of the present invention, there is provided the movable bed according to the third aspect, wherein the plurality of movable mat portions, placed on at least one of the sides of the concave portion of the fixed portion, are composed of a head-side mat surface portion placed on a head side of a person on the moving portion and a foot-side mat surface portion placed on a foot side of the person on the moving portion, and, with either one of the head-side mat surface portion and the foot-side mat surface portion being moved to the retreated position, the moving portion is moved in a width direction of the fixed portion between the head-side mat surface portion and the foot-side mat surface portion so as to be separated from or joined to the fixed portion.

According to a fifth aspect of the present invention, there is provided the movable bed according to the third or fourth aspect, wherein an upper surface of the seat portion of the moving portion is positioned in a center of the mat surface of the mat portion.

According to a sixth aspect of the present invention, there is provided the movable bed according to any one of the third to fifth aspects, wherein the seat portion of the moving portion further includes a thigh resting portion and a foot resting portion, and when the moving portion is separated from or joined to the fixed portion, at least one of upper surfaces of the back resting portion, the leg resting portion, and the foot resting portion is placed above the upper surface of the hip resting portion in a vertical direction.

According to a seventh aspect of the present invention, there is provided the movable bed according to any one of the third to sixth aspects, further comprising:

a driving unit that drives the movable mat portion so that, upon separating the moving portion from the fixed portion, the mat surface of the movable mat portion is moved in association with a separating operation of the moving portion toward a far side with respect to the moving portion, while, upon joining the moving portion to the fixed portion, the mat surface of the movable mat portion is moved in association with a joining operation of the moving portion toward a close side.

According to an eighth aspect of the present invention, there is provided the movable bed according to the seventh aspect, wherein the movable mat portion includes at least head-side mat surface portions and a foot-side mat surface portion, and the driving unit drives the movable mat portion so that the head-side mat surface portions are moved to a center position and the head side and the foot-side mat surface portion is moved from the center toward the foot side at the side.

According to a ninth aspect of the present invention, there is provided the movable bed according to any one of the sixth to eighth aspects, further comprising:

a slide driving mechanism that allows at least one of the mat surfaces of the back resting portion and the leg resting portion of the moving portion to slide in accordance with transformation in the posture state of the moving portion.

According to a 10th aspect of the present invention, there is provided the movable bed according to any one of the sixth to ninth aspects, wherein among a plurality of divided portion driving units and a lift driving unit respectively provided to one of the fixed portion or the moving portion, at least one of the driving units is driven in association with another driving unit so that the movable bed is allowed to carry out at least one of operations including a back-raising operation, a leg-raising operation, and a lifting or lowering operation, with respect to an entire mat surface of the mat portions of the movable bed.

According to an 11th aspect of the present invention, there is provided the movable bed according to any one of the sixth to ninth aspects, wherein among back driving units, leg driving units, and lift driving units respectively provided to the fixed portion and the moving portion, at least one of the paired driving units are driven in synchronism with each other so that the movable bed is allowed to carry out at least one of operations including a back-raising operation, a leg-raising operation, and a lifting or lowering operation, with respect to an entire mat surface of the mat portions of the movable bed.

According to a 12th aspect of the present invention, there is provided the movable bed according to the 11th aspect, further comprising:

a slide mechanism that allows at least one of the mat surfaces of the movable mat portion of the fixed portion as well as the back resting portion and the leg resting portion of the moving portion to slide, in accordance with transformation in the posture states of the fixed portion and the moving portion.

According to a 13th aspect of the present invention, there is provided the movable bed according to any one of the second to 12th aspects, wherein the seat portion of the moving portion is provided with side resting portions on two sides thereof so that, when at least any one of states including the lying posture state, the sitting posture state, and the leg-raised posture state is formed by allowing the plurality of divided portions of the seat portion to be bent with respect to each other, the side resting portions are transformed so as to surround at least one of the back resting portion and the leg resting portion.

EFFECTS OF THE INVENTION

The bed of the present invention makes it possible to safely and swiftly carry out a separating operation or a returning operation from or to the fixed portion of the bed, while a cared person or the like lying thereon is safely kept in a comfortable posture with his or her back or legs being raised, with no member threatening the safety of the cared person being retreated above the bed. Moreover, it is possible to allow the cared person or the like to comfortably lie on the bed and also to move onto a wheel chair from the bed without necessity of moving, as well as to move on the wheel chair safely and comfortably. Therefore, it becomes possible to achieve a bed that reduces load applied to a cared person, that is friendly used by the cared person, and that assists independence of the cared person.

BRIEF DESCRIPTION OF DRAWINGS

These and other aspects and features of the present invention will become clear from the following description taken in conjunction with the preferred embodiments thereof with reference to the accompanying drawings, in which:

FIG. 14 is a perspective view that shows a schematic structure of a movable bed according to a third embodiment of the present invention;

FIG. 15A is a perspective view that shows a schematic structure of the movable bed according to the third embodiment of the present invention, in which side portions are placed adjacent to the movable mat portion of the fixed portion so as to surround the side portions of a person;

DESCRIPTION OF EMBODIMENTS

Figure 1A:
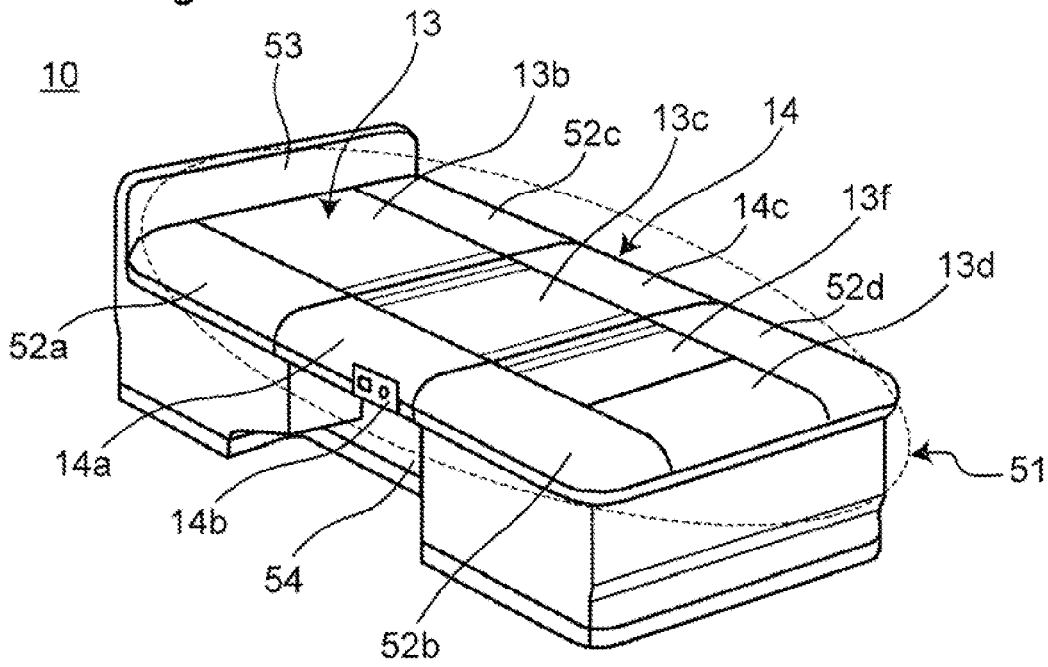
FIG. 1A is a perspective view of a schematic structure of a movable bed, being joined together, according to a first embodiment of the present invention.

Referring to the drawings, the following description will discuss embodiments of the present invention. The same components are indicated by the same symbols, and the explanation thereof will not be provided in some cases. Moreover, in the drawings, for easier understanding, respective components are mainly illustrated schematically.

First Embodiment

Figure 1B:
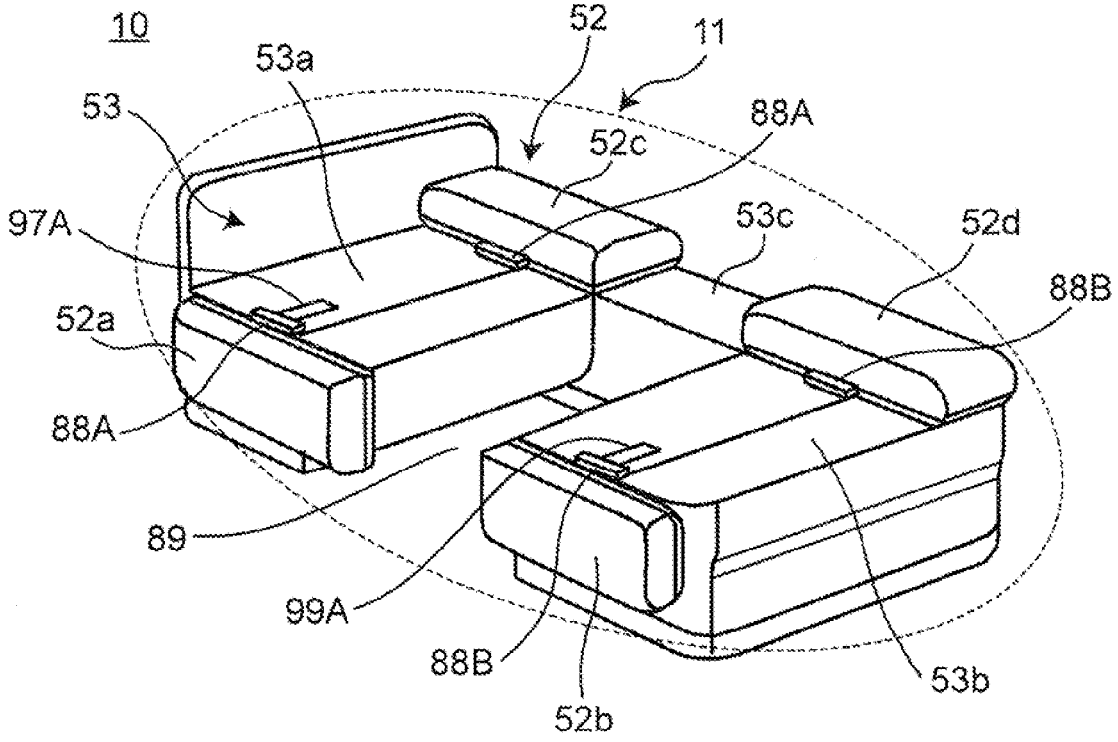
FIG. 1B is a perspective view that shows a schematic structure of a fixed portion when a moving portion is separated from the fixed portion in the movable bed according to the first embodiment of the present invention.

FIG. 1A shows a schematic structure of a movable bed 10 according to the first embodiment of the present invention, in a perspective view of the movable bed 10 integrally formed by joining a fixed portion 11 and a moving portion 12 with each other. FIG. 1B is a perspective view showing the fixed portion 11 when the movable bed 10 is separated, and FIG. 1C is a perspective view showing the moving portion 12 when the movable bed 10 is separated.

Figure 1C:
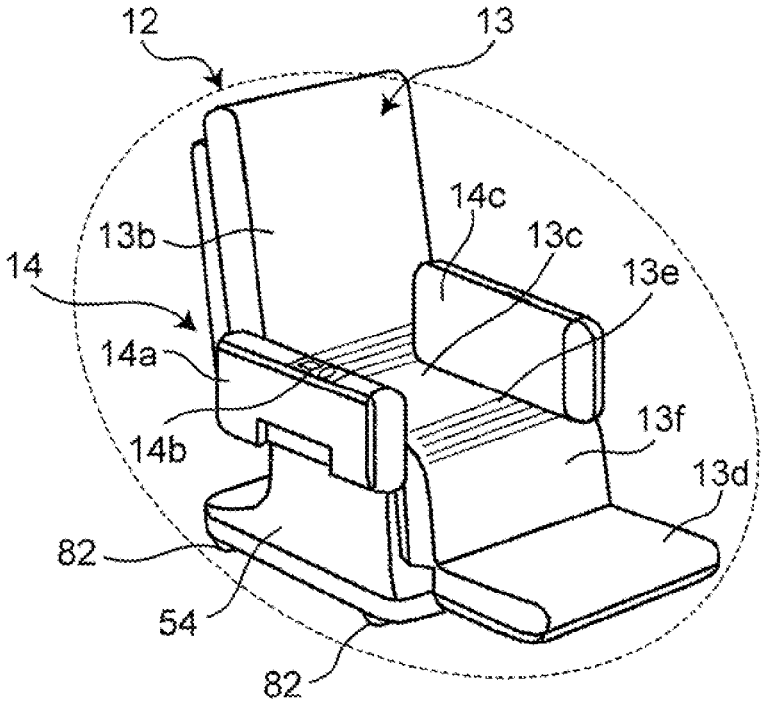
FIG. 1C is a perspective view that shows a schematic structure of the moving portion when the moving portion is separated from the fixed portion in the movable bed according to the first embodiment of the present invention.

As shown in FIGS. 1A, 1B, and 1C, the movable bed 10 of the first embodiment has a structure in which a mat portion 51 of the bed allowing a person lie thereon (lie about) is composed of a part of the fixed portion 11 and a part of the moving portion 12.

The fixed portion 11 of the movable bed 10 is constituted by a bed base portion 53 (a head-side base portion 53*a*, a foot-side base portion 53*b*, and a joining portion 53*c*), a mat surface portion (movable mat portion) (head-side mat surface portions 52*a* and 52*c*, and foot-side mat surface portions 52*b* and 52*d*). In this case, the fixed portion 11 is a member that is left after the moving portion 12 functioning as a wheel chair has been separated from the movable bed 10. This fixed portion 11 is not a member without any wheels or the like, but may have wheels or the like on the bottom portion so as to be used when the movable bed 10 is moved to be disposed in a room or the like. Moreover, the head side refers to the head side of a person riding on the moving portion 12 (placed on the moving portion 12), and the foot side refers to the foot side of a person riding on the moving portion 12 (placed on the moving portion 12).

Furthermore, the moving portion 12 of the movable bed 10 can be separated from the fixed portion 11 or be joined to the fixed portion 11, and is designed as a wheel chair that can be transformed between a lying posture state and a sitting posture state. The moving portion 12 includes a seat portion 13 (provided at least with a back resting portion 13*b*, a hip resting portion 13*c*, a leg resting portion 13*f*, and a foot resting portion 13*d*), an armrest portion 14 (provided at least with a right-side armrest portion 14*a*, an operation panel 14*b*, and a left-side armrest portion 14*c*), and a cart portion 54 provided with a wheel driving source 81 such as a motor, which drives wheels 82 to rotate positively/negatively. For example, the four wheels 82 are driven to be rotated positively/negatively by the driving operation of the wheel driving source 81, and the moving portion 12 is allowed to move forward or rearward as well as rightward or leftward, or to rotate positively or negatively. In the case where the moving portion 12 is joined to the fixed portion 11 to form the movable bed 10, the upper surface of the seat portion 13 of the moving portion 12 and the inner surface of the armrest portion 14 are allowed to virtually form one plane serving as the mat surface of the mat portion 51 of the movable bed 10.

In this case, the mat portion 51 corresponds to a mattress of an ordinary bed, and the mat surface of the mat portion 51 corresponds to the surface of the mattress on which a person lies thereon (lies about). Moreover, the surface of the mat portion 51 is composed of the seat portion 13, the armrest portion 14, and the head-side mat surface portions 52*a* and 52*c* as well as the foot-side mat surface portions 52*b* and 52*d*, which are adjacent to these portions. That is, in the center of the mat surface of the mat portion 51, the seat portion 13 is disposed in the longitudinal direction of the movable bed 10 (bed longitudinal direction). On the left side of the seat portion 13 in FIG. 1A, the head-side mat surface portion 52*a*, the armrest portion 14*a* on the right side, and the foot-side mat surface portion 52*b* are disposed, while on the right side of the seat portion 13 in FIG. 1B, the head-side mat surface portion 52*c*, the armrest portion 14*c* on the left side, and the foot-side mat surface portion 52*d* are disposed.

Moreover, on a side of the armrest portion 14*a* on the right side in the armrest portion 14, an operation panel (remote controller) 14*b* for controlling the operations of the movable bed 10 is placed. In the state where the fixed portion 11 and the moving portion 12 are joined to each other (the state shown in FIG. 1A), this operation panel 14*b* is placed on a side of the armrest portion 14*a* on the right side in the armrest portion 14, while, in the state where the moving portion 12 functions as the wheel chair (the state shown in FIG. 1C), it is placed on the upper side in the vertical direction of the armrest portion 14*a* on the right side. With this arrangement, a care giver or a cared person is allowed to operate the movable bed 10 more easily.

In this case, since the operation panel 14*b* functions also as a remote controller, the operation panel 14*b* can be detached from the armrest portion 14*a* on the right side. By communicating with a receiver device (not shown) inside the moving portion 12 with the operation panel (remote controller) 14*b* being detached from the armrest portion 14*a* on the right side, the movable bed 10 and the moving portion 12 can be externally operated. In the present first embodiment, the explanation is given of the structure in which the operation panel (remote controller) 14*b* is provided to the armrest portion 14*a* on the right side; however, it is only necessary to provide the operation panel 14*b* at least on either one of the armrest portion 14*a* on the right side and the armrest portion 14*c* on the left side. The layout thereof is desirably determined at an appropriate position by taking into consideration a relationship with walls or the like of the room in which the movable bed 10 is placed, for example, on one of the paired armrest portions not facing any wall of the movable bed 10.

As will be described later in detail, this structure makes it possible to safely and swiftly separate the moving portion 12 from the fixed portion 11 of the bed 10 or return the moving portion 12 to be joined with the fixed portion 11, while a lying cared person or the like is allowed to have a comfortable posture, such as a back-raised posture or a leg-raised posture. Therefore, it is possible to achieve such a movable bed 10 that allows the cared person or the like to comfortably lie down on the bed 10, and also allows to move safely and comfortably on the wheel chair (moving portion 12) having the shape shown in FIG. 1C, without applying much load to the care giver. Moreover, in the state of the movable bed 10, since the bed integrally includes the wheel chair (moving portion 12), it is not necessary to secure a storage space for the wheel chair (moving portion 12) other than within the movable bed 10 while the bed (movable bed 10) is used.

The following description will specifically discuss operations carried out when the movable bed 10 of the first embodiment is separated into the fixed portion 11 and the moving portion 12.

Figure 2:
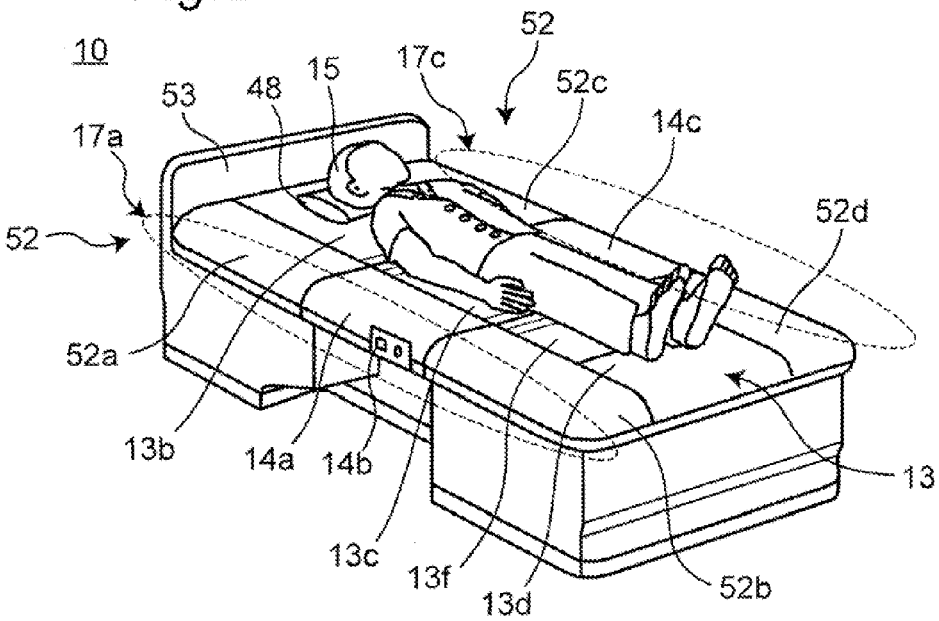
FIG. 2 is a perspective view that shows a state where a person such as a cared person is lying in a lying posture on a mat surface of a mat portion in the movable bed with the fixed portion and the moving portion being joined together, according to the first embodiment of the present invention.

FIG. 2 is a perspective view that shows a state where a person 15, such as a cared person, is lying (lying about) on the mat surface of the mat portion 51, in the state shown in FIG. 1A where the fixed portion 11 and the moving portion 12 are joined to each other to form the movable bed 10.

As shown in FIG. 2, in the seat portion 13 of the moving portion 12, the plurality of divided portions 13*b*, 13*c*, and 13*d*, which include at least the back resting portion 13*b*, the hip resting portion 13*c*, and the foot resting portion 13*d*, are coupled to one another so as to be freely bent. By allowing the plurality of divided portions 13*b*, 13*c*, and 13*d* to be bent with respect to each other, at least any one of posture states out of the lying posture state shown in FIG. 2, the sitting posture state (see FIG. 5) to be described later, and the back-raised and leg-raised posture state (see FIG. 3) can be formed. That is, in the lying posture state shown in FIG. 2, in the seat portion 13 of the moving portion 12, the coupling portions of the back resting portion 13*b*, the hip resting portion 13*c*, and the foot resting portion 13*d* are not bent with respect to each other, so that one plane is formed. In the sitting posture state shown in FIG. 5, at least the back resting portion 13*b*, the hip resting portion 13*c*, and the foot resting portion 13*d* in the seat portion 13 of the moving portion 12 are bent with respect to each other at the coupling portions therebetween. In the back-raised and leg-raised posture state shown in FIG. 3, at least the back resting portion 13*b*, the hip resting portion 13*c*, and the foot resting portion 13*d* in the seat portion 13 of the moving portion 12 are bent with respect to each other at the coupling portions; however, the bent angles and the bent portions are different from those in the sitting posture state.

Figure 1D:
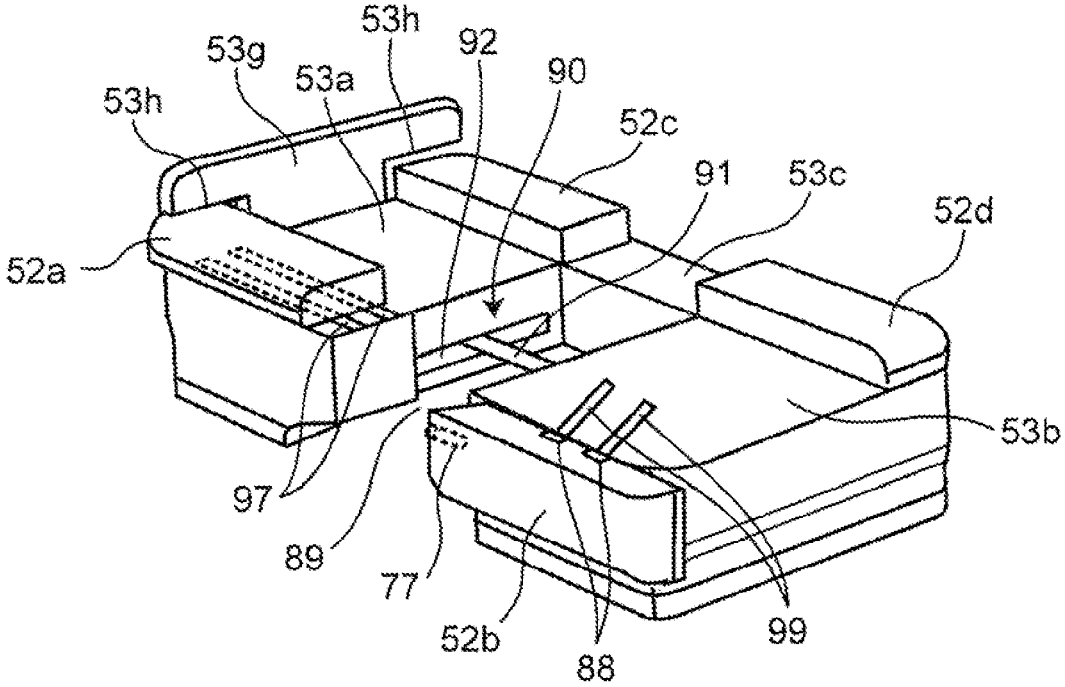
FIG. 1D is a perspective view that shows a structure of a driving unit of the fixed portion of the movable bed according to the first embodiment of the present invention.
Figure 1E:
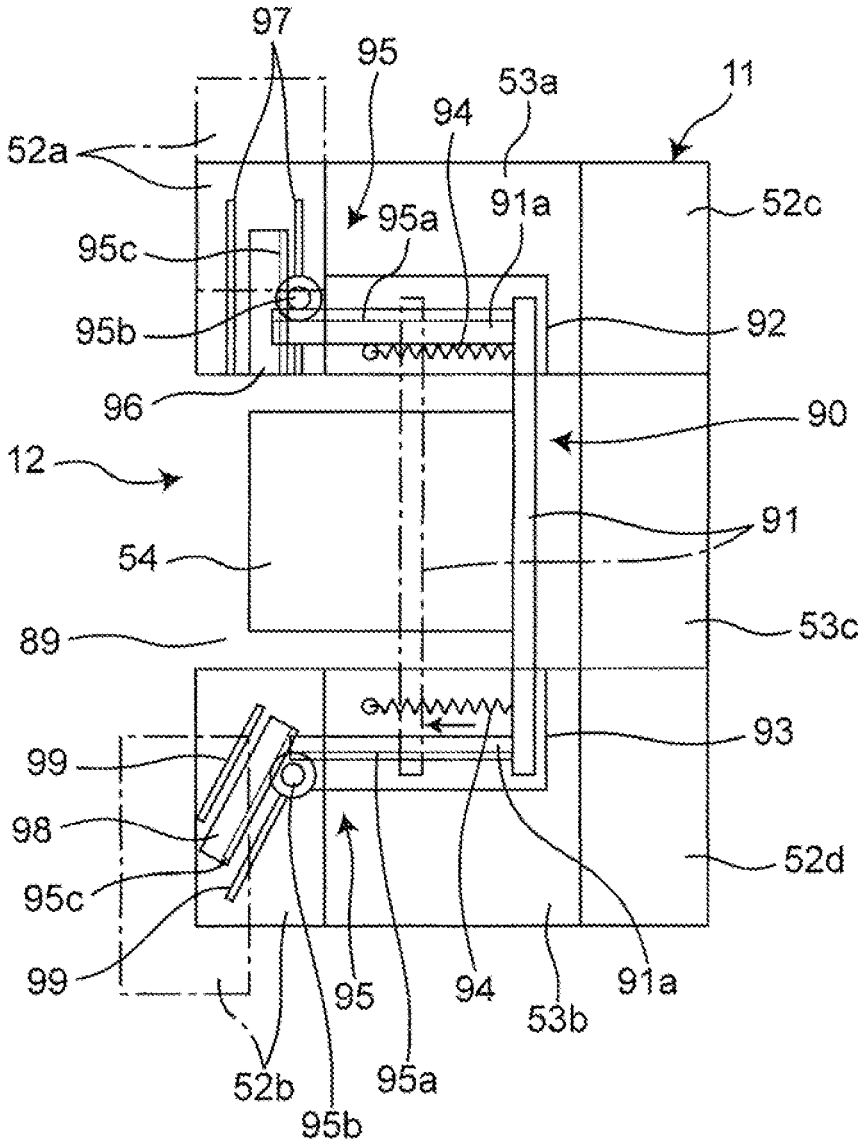
FIG. 1E is a partially perspective plan view that shows a structure of the driving unit of the fixed portion of the movable bed according to the first embodiment of the present invention.
Figure 1F:
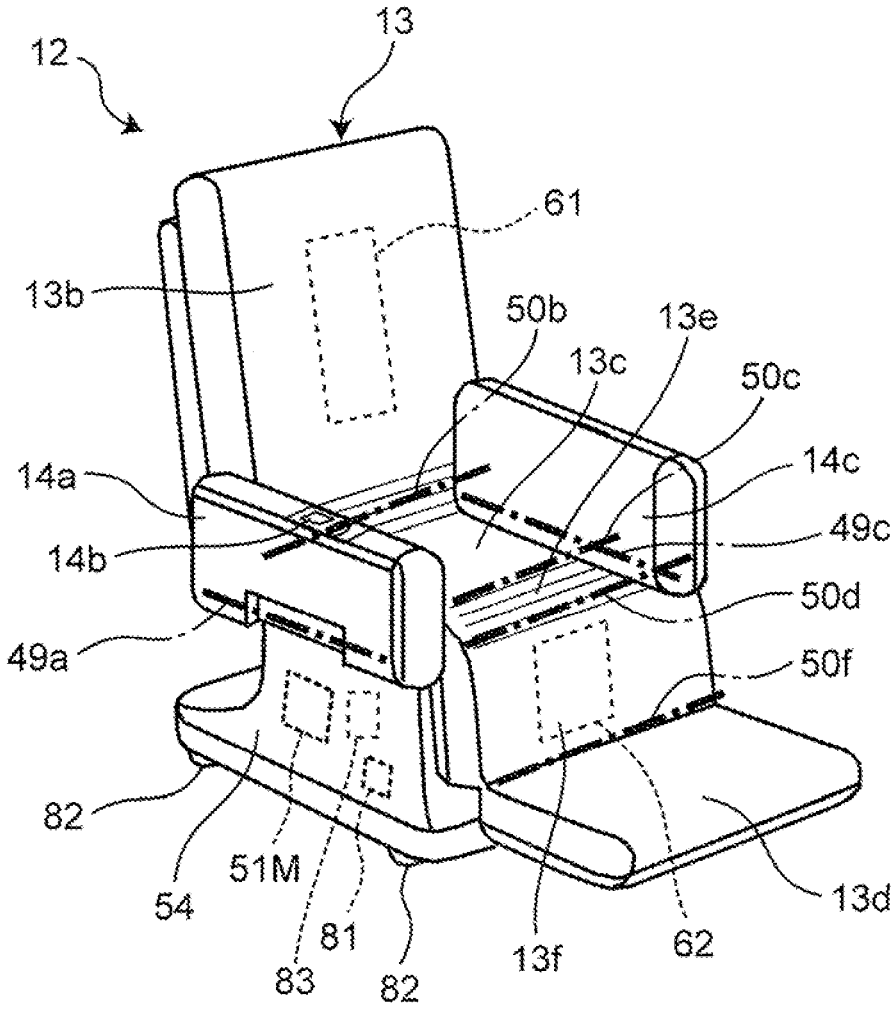
FIG. 1F is a perspective view that shows a structure of a driving unit of the moving portion of the movable bed according to the first embodiment of the present invention.

In each of a bending portion between the back resting portion 13*b* and the hip resting portion 13*c* and a bending portion between the hip resting portion 13*c* and the leg resting portion 13*f* (two portions on the hip resting portion 13*c* side and the leg resting portion 13*f* side of the thigh resting portion 13*e*) as well as a bending portion between the leg resting portion 13*f* and the foot resting portion 13*d*, rotary shafts 50*b*, 50*c*, 50*d*, and 50*f* are disposed so as to rotate positively/negatively along the rotation center axis of bending operations, as shown in FIG. 1F. Each of the rotary shafts 50*b*, 50*c*, 50*d*, and 50*f* is coupled to one or a plurality of rotation driving sources 51M, such as motors, and, for example, encoders 80*b*, 80*c*, 80*d*, and 80*f* (see FIG. 1G), which are connected to a control device 100, are provided to the respective rotary shafts 50*b*, 50*c*, 50*d*, and 50*f*. Thus, the rotation angles of the respective rotary shafts 50*b*, 50*c*, 50*d*, and 50*f*, detected by the encoders 80*b*, 80*c*, 80*d*, and 80*f*, are inputted to the control device 100, and based upon the controlling operations of the control device 100 to which the rotation angles have been inputted, the rotation driving source 51M drives the positive/negative rotations of the rotary shafts 50*b*, 50*c*, 50*d*, and 50*f*, respectively.

Moreover, as shown in FIG. 1F, at a border portion between each of the armrest portions 14*a* and 14*c* and the hip resting portion 13*c*, rotary shafts 49*a* and 49*c* are also disposed so as to be rotated positively/negatively along the rotation center axis of bending operations. Each of the rotary shafts 49*a* and 49*c* is coupled to one or a plurality of rotation driving sources 51M, such as motors, and, for example, encoders 79*a* and 79*c* (see FIG. 1G), which are connected to the control device 100, are provided to the rotary shafts 49*a* and 49*c*, respectively. Thus, the rotation angles of the respective rotary shafts 49*a* and 49*c*, detected by the encoders 79*a* and 79*c*, are inputted to the control device 100, and based upon the controlling operations of the control device 100 to which the rotation angles have been inputted, the rotation driving source 51M drives the positive/negative rotations of the rotary shafts 49*a* and 49*c*.

By the driving operations on positive/negative rotations of the rotary shafts 49*a* and 49*c*, the armrest portions 14*a* and 14*c* are rotated to be raised toward the person 15 relative to the hip resting portion 13*c*, or to be lowered in the reverse direction (to be pivoted from a sideway lying posture state to an upright posture state, or to be pivoted rearwardly from the upright posture state to the sideway lying posture state).

Figure 1G:
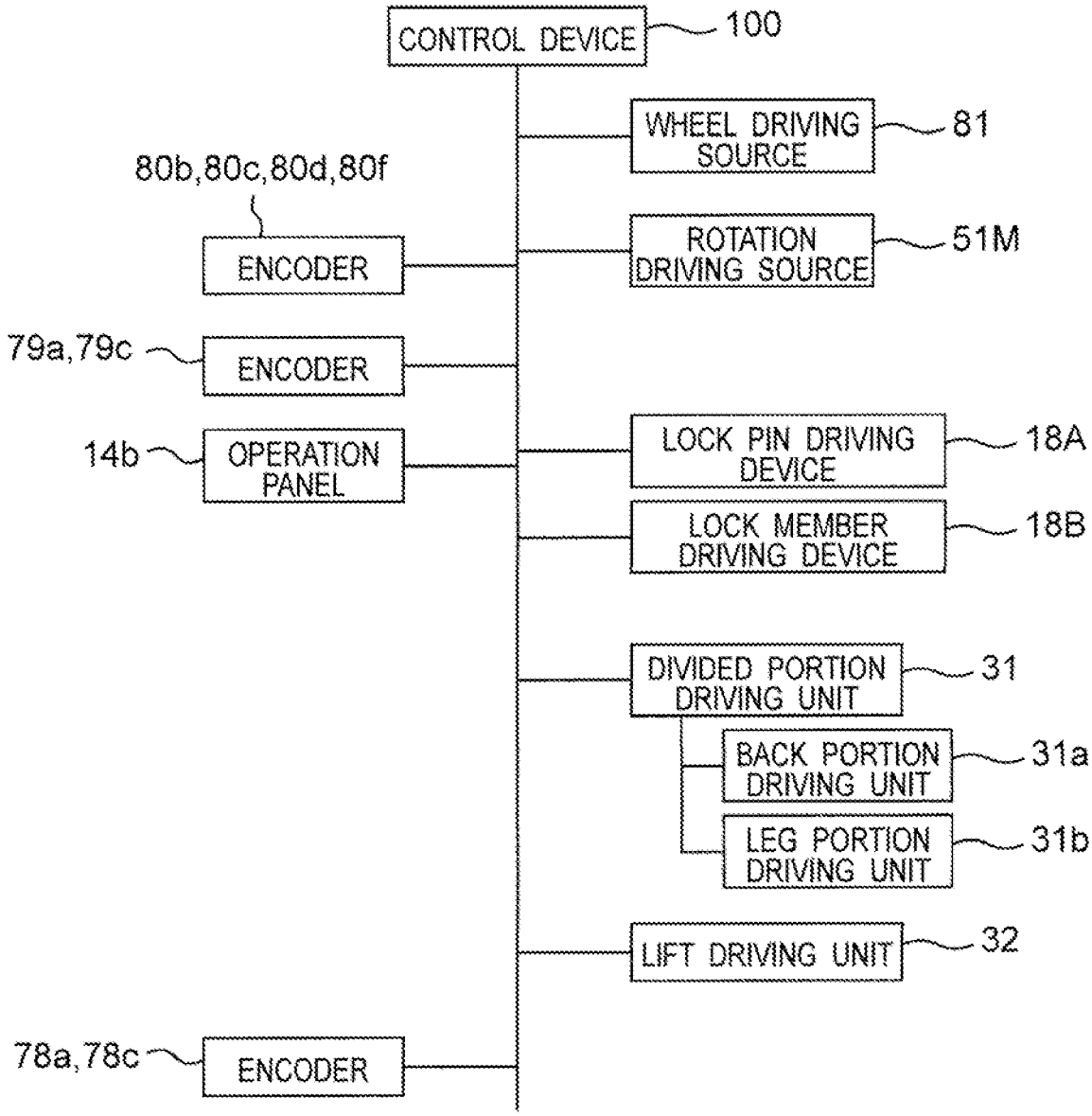
FIG. 1G is a block view that shows structures of a control device, a driving source, and the like of the movable bed according to the first embodiment of the present invention.

As shown in FIG. 1G, the control device 100 independently controls operations of the rotation driving source 51M for driving the bending operations in the seat portion 13, the wheel driving source 81 provided to the cart portion 54, a lock pin driving device 18A, and a lock member driving device 18B. Information is inputted to the control device 100 from each of the operation panel (remote controller) 14*b*, the encoders 80*b*, 80*c*, 80*d*, 80*f*, and the like, and based upon the inputted information, the control device 100 controls the rotation driving source 51M, the wheel driving source 81, the lock pin driving device 18A, and the lock member driving device 18B so that desired operations are carried out in the movable bed 10.

Moreover, the upper surface of the seat portion 13 of the moving portion 12 is designed to be located in the center of the mat surface of the mat portion 51, as shown in FIG. 2.

With this structure, it is not necessary for the person 15, such as a cared person, to once get off from the movable bed 10 and move all the way to the portion to move as a wheel chair (the moving portion 12 in the first embodiment), but, for example, it is only necessary for the person to lie at a same position on the movable bed 10 as that in the case of using as a bed (in other words, the person 15 is kept in the lying posture state without necessity of changing his or her posture by himself/herself), and the person 15 is allowed to utilize both of the functions of the movable bed 10 and the wheel chair (moving portion 12). Moreover, by using the movable bed 10 of the first embodiment, for example, even a person with disability in his or her legs or even a person who has been injured in his or her leg and cannot move sufficiently is allowed to easily move himself or herself from the bed to the wheel chair, and to move to a desired place by using the wheel chair without requiring any load, so that the person can move independently. Moreover, it is possible to easily carry out, for example, a bed-leaving assist job for a bedridden cared person.

Figure 3:
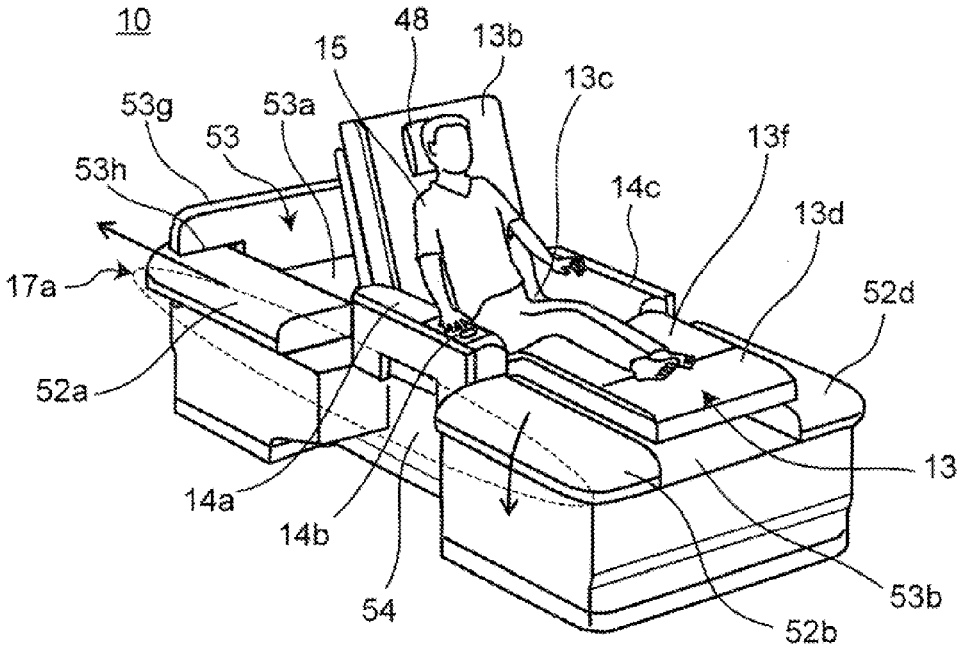
FIG. 3 is a perspective view that shows a state where, on the movable bed according to the first embodiment of the present invention, the moving portion is being separated from the fixed portion by transforming the moving portion from a lying posture state to a back-raised and leg-raised posture state so as to have the person in the lying posture state changed into the back-raised and leg-raised posture state.
Figure 4:
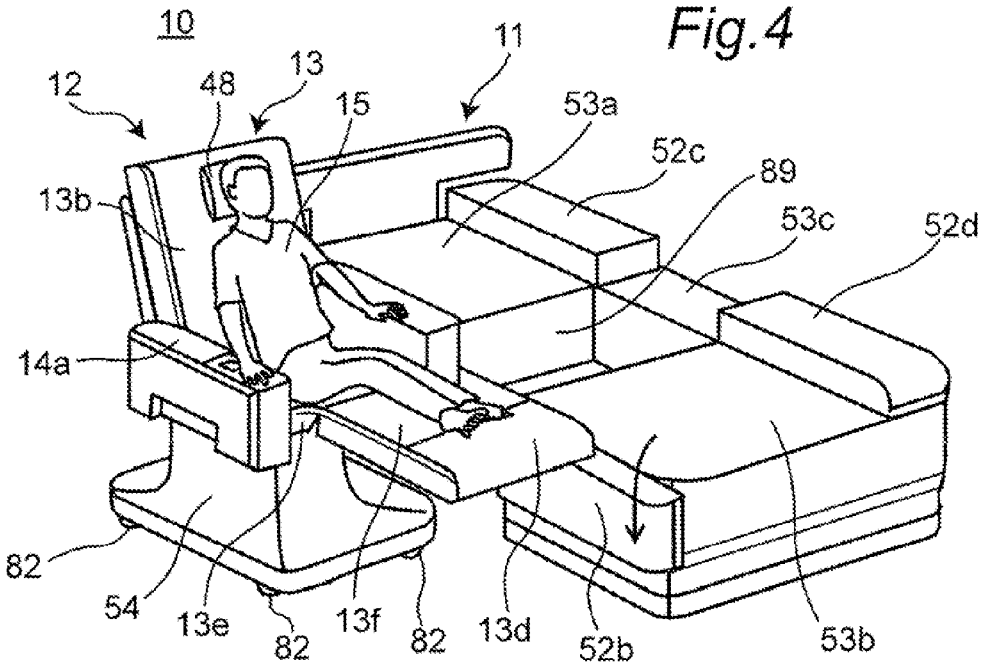
FIG. 4 is a perspective view that shows a state where, on the movable bed according to the first embodiment of the present invention, the moving portion in the back-raised and leg-raised posture state is being separated from the fixed portion, with the person in his or her back-raised and leg-raised posture state being carried on the moving portion.
Figure 5:
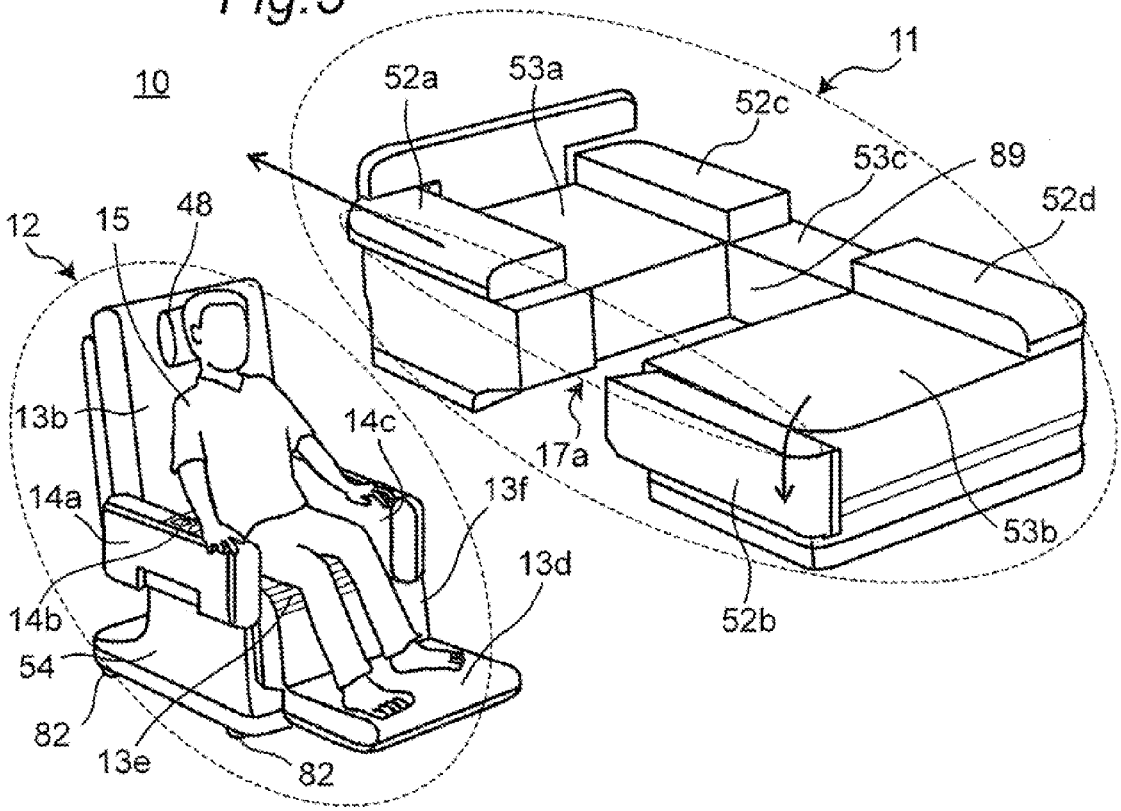
FIG. 5 is a perspective view that shows a state where, on the movable bed according to the first embodiment of the present invention, the moving portion has been already separated from the fixed portion and is being changed into a wheel chair state.

FIG. 3 is a perspective view that shows a state where, by driving the rotation driving source 51M under the control of the control device 100, at least the back resting portion 13*b*, the hip resting portion 13*c*, and the foot resting portion 13*d* of the moving portion 12 of the movable bed 10 are operated to be bent, and the moving portion 12 is transformed from the lying posture state to the back-raised and leg-raised posture state, so that the person 15 is changed from the lying posture state into the back-raised and leg-raised posture state, and the moving portion 12 is about to be separated from the fixed portion 11. FIG. 4 is a perspective view that shows a state where, by driving the wheel driving source 81 under the control of the control device 100, the moving portion 12 in the back-raised and leg-raised posture state, which carries thereon the person 15 in his or her back-raised and leg-raised posture state, is being separated from the fixed portion 11. FIG. 5 is a perspective view that shows a state where, by driving the rotation driving source 51M under the control of the control device 100, the separation of the moving portion 12 from the fixed portion 11 is completed, and the moving portion 12 is being transformed from the back-raised and leg-raised posture state to the wheel chair state (in this case, the state of the wheel chair in the sitting posture state). In FIG. 5, the person 15 is in the sitting posture state, and sits on the moving portion 12 in the wheel chair state (in this case, the state of the wheel chair in the sitting posture state).

As shown in FIGS. 3 to 5, the seat portion 13 of the moving portion 12 is designed to further include a thigh resting portion 13*e* and the leg resting portion 13*f* in addition to the back resting portion 13*b*, the hip resting portion 13*c*, and the foot resting portion 13*d*. More specifically, the thigh resting portion 13*e* and the leg resting portion 13*f* are placed between the hip resting portion 13*c* and the foot resting portion 13*d*, and the thigh resting portion 13*e* is formed as a bending portion. As one example, in the case of transforming from the lying posture state of FIG. 2 to the back-raised and leg-raised posture state of FIG. 3, the rotation driving source 51M is driven under the control of the control device 100 so that the coupling portion between the back resting portion 13*b* and the hip resting portion 13*c* is bent so as to protrude downward, while the coupling portion (the thigh portion 13*e*) between the hip resting portion 13*c* and the leg resting portion 13*f* is bent so as to protrude upward, with the coupling portion between the leg resting portion 13*f* and the foot resting portion 13*d* being maintained to be planar without being bent. From the state of FIG. 3 to the state of FIG. 4, the back-raised and leg-raised posture state is kept without being changed. In the case where the back-raised and leg-raised posture state of FIG. 4 is changed to the sitting posture state, the rotation driving source 51M is driven under the control of the control device 100 so that the bent state at the coupling portion between the back resting portion 13*b* and the hip resting portion 13*c* is kept substantially as it is, with the coupling portion (the thigh resting portion 13*e*) between the hip resting portion 13*c* and the leg resting portion 13*f* being further bent so as to protrude upward and the coupling portion between the leg resting portion 13*f* and the foot resting portion 13*d* being largely bent so as to protrude downward.

In contrast, in the case where the moving portion 12 is separated from or joined to the fixed portion 11, the rotation driving source 51M and the wheel driving source 81 are driven under the control of the control device 100 so that the upper surface of the back resting portion 13*b* and the upper surfaces of the leg resting portion 13*f* and the foot resting portion 13*d* are moved in states where they are respectively located on the upper side in the vertical direction with respect to the upper surface of the hip resting portion 13*c* (in other words, in the back-raised and leg-raised posture state). In the state where the moving portion 12 has been brought into the back-raised and leg-raised posture state, as shown in FIG. 4, the seat portion 13 of the moving portion 12 passes immediately above the fixed portion 11 of the movable bed 10, so that the moving portion 12 is separated and spaced apart from the fixed portion 11. Thereafter, as shown in FIG. 5, the moving portion 12 is transformed from the back-raised and leg-raised posture state into the sitting posture state so that the person 15 is changed from the back-raised and leg-raised posture state into the sitting posture state; thus, the moving portion 12 is completely transformed into the wheel chair in the sitting posture state, as shown in FIG. 5.

In this structure, in a state where no member has retreated above the bed and thus causes safety problems to the cared person, the moving portion 12 can be separated from or returned to the fixed portion 11 without intervening with the fixed portion 11 of the movable bed 10, so that the lying person 15 such as a cared person can utilize the bed reliably and safely. Moreover, the moving portion 12 can be smoothly and swiftly separated from or joined to the fixed portion 11 of the movable bed 10, so as to be transformed into the wheel chair state for allowing the person 15 to take desired postures, such as a reclining posture, a tilted posture, a sitting posture, and the like.

As shown in FIGS. 2 to 5, when the moving portion 12 is separated from or joined to the fixed portion 11, the wheel driving source 81 is driven under the control of the control device 100 while measuring positions of the fixed portion 11 and the moving portion 12 by using a position sensor 83 provided to the moving portion 12 as shown in FIG. 1F, so that, as shown in FIG. 2, based upon a positional relationship measured by the position sensor 83, they are separated from each other or joined together by approaching or departing in either one of the directions toward two sides 17*a* and 17*c* of the movable bed 10 along the height of the person 15 (along the longitudinal direction of the bed). The movement of approaching or departing in either one of the directions toward the two sides 17*a* and 17*c* is carried out by driving the cart portion 54 based upon information detected by the position sensor 83 disposed to the cart portion 54.

With this structure, even when the moving portion is separated and departs from the fixed portion 11 of the movable bed 10 as the wheel chair or is returned (joined) to the fixed portion 11, it is only necessary to secure a space with a slight margin on either one of the two sides 17*a* and 17*c* for the installation place of the movable bed 10, so that the movable bed 10 can be installed in a small space. As an example, in FIGS. 2 to 5, the moving portion 12 is designed to be separated from or joined to the fixed portion 11 in the center of the side 17*a* of the movable bed 10.

Moreover, the separating or joining operation of the moving portion 12 is carried out in a manner so as to cross either one of the two sides 17*a* and 17*c* of the movable bed 10. With this structure, since the moving portion can depart in either one of the directions toward the sides of the movable bed 10, this bed can be applied to various bed layouts. Thus, it is possible to achieve the movable bed 10 having a high degree of flexibility for installation positions in a room. On either one of the two sides 17*a* and 17*c* where the moving portion 12 does not cross, a joining portion 53*c* for use in coupling the head-side base portion 53*a* and the foot-side base portion 53*b* is attached. This joining portion 53*c*, which can be freely detachable, may be attached to either one of the two sides 17*a* and 17*c*, so that, by causing the moving portion 12 to be in contact with the joining portion 53*c*, the joining portion 53 also functions as a stopper for preventing the moving portion 12 from being separated in an erroneous direction and for regulating the position of the moving portion 12.

In the sequence of operations shown in FIGS. 2 to 5 in which the moving portion 12 of the movable bed 10 is separated from the fixed portion 11, the fixed portion 11 is provided with the movable mat portion 52 (the head-side mat surface portions 52*a* and 52*c* and the foot-side mat surface portions 52*b* and 52*d*) that are respectively disposed in a divided manner on the two sides 17*a* and 17*c*. The fixed portion 11 of the movable bed 10 is provided with a driving unit 90 so as to allow the movable mat portion 52 to move in association with the movement of the moving portion 12. As shown in FIG. 3, in the case where the moving portion 12 is separated from the fixed portion 11, the driving unit 90 moves the movable mat portion 52 toward the side farther apart from the moving portion 12 in association with the movement of the moving portion 12, together with the separation of the moving portion 12 from the fixed portion 11. On the other hand, in the case where the moving portion 12 is joined to the fixed portion 11, the driving unit 90 moves the movable mattress portion 52 toward the side closer to the moving portion 12 in association with the movement of the moving portion 12, together with the joining of the moving portion 12 to the fixed portion 11.

For example, the driving unit 90 has the following structure, as shown in FIGS. 1D and 1E.

In the present embodiment, for simplifying the structure, the driving unit 90 is provided as a mechanism for operating the head-side mat surface portion 52*a* or 52*c* and the food-side mat surface portion 52*b* or 52*d* to respectively move in association with the moving operations (a separating operation and a joining operation) of the moving portion 12. Alternatively, the head-side mat surface portion 52*a* and 52*c* and the foot-side mat surface portion 52*b* and 52*d* may be provided with individual driving mechanisms, and operated individually. For example, the driving unit 90 is constituted by a movable bar 91, a spring 94 as one example of a biasing member, a displacement conversion mechanism 95, a head-side rod 96, a head-side guide rail 97 as one example of a head-side guide member, a foot-side rod 98, a foot-side guide rail 99 as one example of a foot-side guide member, and the like.

More specifically, when the moving portion 12 is joined to the fixed portion 11, the moving portion 12 is inserted into a concave portion 89 in the center between the head-side base portion 53*a* and the foot-side base portion 53*b* of the fixed portion 11. Near the bottom of the concave portion 89, the movable bar 91, which is allowed to proceed or retreat in parallel with the width direction of the fixed portion 11, is disposed with two ends thereof being inserted into a cut-out portion 92 of the head-side base portion 53*a* and a cut-out portion 93 of the foot-side base portion 53*b*. Therefore, from the position of the moving portion 12 inserted into the proximity of the center in the concave portion 89 of the fixed portion 11 to the position where the joining of the moving portion 12 to the fixed portion 11 is completed, the movable bar 91 is always kept in contact with the outer surface of the cart portion 54 of the moving portion 12 by the biasing force of the spring 94 as one example of a biasing member. The movable bar 91 is disposed in this manner, and the movable bar 91 is coupled to the head-side rod 96 and the foot-side rod 98*a* through the known displacement conversion mechanism 95 that converts a force acting in the width direction of the fixed portion 11 to force in the bed longitudinal direction (the direction along the height of the person) orthogonal to the width direction.

First, the head-side rod 96 is coupled to the head-side mat surface portion 52*a* or 52*c*. As the displacement conversion mechanism 95, for example, a mechanism is proposed in which, after a linear motion has been once converted to a rotational motion, the rotational motion can be converted to a linear motion in a direction orthogonal to the motion direction of the linear motion or a linear motion in a direction crossing the motion direction thereof. More specifically, in a simplified explanation, a rack 95*a* is provided to a driving bar 91*a* that protrudes in the width direction from the movable bar 91, and a pinion gear 95*b* to be engaged with the rack 95*a* is placed so that a rack 95*c* of the head-side rod 96 is engaged with this pinion gear 95*b*. With this structure, the linear motion of the movable bar 91 in the width direction can be converted to a linear motion in the longitudinal direction of the head-side rod 96 through a rotational motion of the pinion gear 95*b*. Not limited to this mechanism, various known mechanisms can be adopted as the displacement conversion mechanism 95. On the other hand, on the two sides of the head-side base portion 53*a* of the fixed portion 11, a single or a pair of head-side guide rails 97, each of which is one example of a head-side guide member that extends in a direction along the height of the person 15 (the bed longitudinal direction), are fixed. Therefore, the head-side mat surface portion 52*a* or 52*c* is allowed to move along the head-side guide rail 97 between a close position (a bed formation position) where the head-side mat surface portion 52*a* or 52*c* is close to the armrest portion 14*a* or 14*c* and a separated position (a retreated position) on the far side where the head-side mat surface portion 52*a* or 52*c* departs from the armrest portion 14*a* or 14*c*.

Therefore, when the moving portion 12, which has been inserted into the concave portion 89 of the fixed portion 11 and then jointed thereto, is about to get out of the concave portion 89 so as to be separated from the fixed portion 11, the movable bar 91 moves from one end side of the fixed portion 11 in the width direction toward the center (leftward from the right end side in FIG. 1E) together with the moving portion 12. Along with the movement of the movable bar 91, the head-side mat surface portion 52*a* or 52*c* is moved from the close position (the bed formation position indicated by a solid line in FIG. 1E) that is close to the armrest portion 14*a* or 14*c* to the separated position (the retreated position indicated by a chain line in FIG. 1E) on the far side separated from the armrest portion 14*a* or 14*c*, along the head-side guide rail 97, via the displacement conversion mechanism 95 and the head-side rod 96.

In contrast, in the case where the moving portion is inserted into the concave portion 89 of the fixed portion 11 from the outside of the concave portion 89 so that the moving portion 12 is jointed to the fixed portion 11, the movable bar 91 moves in the concave portion 89 from the center in the width direction of the fixed portion 11 toward the one end side (from the left side toward the right end side in FIG. 1E) together with the moving portion 12. Along with the movement of the movable bar 91, the head-side mat surface portion 52*a* or 52*c* is moved from the separated position (the retreated position indicated by the chain line in FIG. 1E) on the far side separated from the armrest portion 14*a* or 14*c* to the close position (the bed formation position indicated by the solid line in FIG. 1E) that is close to the armrest portion 14*a* or 14*c* along the head-side guide rail 97, via the displacement conversion mechanism 95 and the head-side rod 96.

In the same manner, the foot-side mat surface portion 52*b* or 52*d* is also coupled to the displacement conversion mechanism 95 of the movable bar 91 through the foot-side rod 98. On the two sides of the foot-side base portion 53*b* of the fixed portion 11, a single or a pair of foot-side guide rails 99, each of which is one example of a foot-side guide member that extends to depart from the armrest portion 14*a* or 14*c* (that is, in a diagonally outward direction relative to the direction along the height of the person 15 (the bed longitudinal direction), are fixed. Thus, the foot-side mat surface portion 52*b* or 52*d* is allowed to move along the foot-side guide rail 99 between the close position (the bed formation position indicated by the solid line of FIG. 1E) where the foot-side mat surface portion 52*b* or 52*d* is close to the armrest portion 14*a* or 14*c* and the separated position (the retreated position indicated by the chain line of FIG. 1E) on the far side where the foot-side mat surface portion 52*b* or 52*d* departs diagonally outward from the armrest portion 14*a* or 14*c* and is also rotated in a manner so as to be bent along the vertical direction by a rotation hinge 88 as one example of a rotation coupling member on an outer end of the foot-side guide rail 99.

Therefore, when the moving portion 12, which has been inserted into the concave portion 89 of the fixed portion 11 and thus jointed to the fixed portion 11, is about to get out of the concave portion 89 so as to be separated from the fixed portion 11, the movable bar 91 moves from the one end side of the fixed portion 11 in the width direction toward the center (leftward from the right end side in FIG. 1E) together with the moving portion 12. Along with the movement of the movable bar 91, the foot-side mat surface portion 52*b* or 52*d* is moved along the foot-side guide rail 99 from the close position (the bed formation position indicated by the solid line in FIG. 1E) that is close to the armrest portion 14*a* or 14*c* in a manner so as to be pushed out via the displacement conversion mechanism 95 and the foot-side rod 98, to the separated position (the retreated position indicated by the chain line in FIG. 1E) on the far side where the foot-side mat surface portion 52*b* or 52*d* departs diagonally outward from the armrest portion 14*a* or 14*c* and is rotated in a manner so as to be bent along the vertical direction by the rotation hinge 88 as one example of the rotation coupling member on the outer end of the foot-side guide rail 99. At this time, as described earlier, the head-side mat surface portion 52*a* or 52*c* has also been moved to the separated position (the retreated position indicated by the chain line in FIG. 1E).

In contrast, in the case where the moving portion is inserted into the concave portion 89 of the fixed portion 11 from the outside of the concave portion 89 so that the moving portion 12 is jointed to the fixed portion 11, the movable bar 91 moves in the concave portion 89 from the center in the width direction of the fixed portion 11 toward the one end side (from the left side toward the right end side in FIG. 1E) together with the moving portion 12. Along with the movement of the movable bar 91, the foot-side mat surface portion 52*b* or 52*d* is moved along the foot-side guide rail 99 from the separated position (the retreated position indicated by the chain line in FIG. 1E) on the far side separated from the armrest portion 14*a* or 14*c* to the close position (the bed formation position indicated by the solid line in FIG. 1E) that is close to the armrest portion 14*a* or 14*c*, via the displacement conversion mechanism 95 and the foot-side rod 98. At this time, as described earlier, the head-side mat surface portion 52*a* or 52*c* has also been moved to the close position (the bed formation position indicated by the solid line in FIG. 1E).

Moreover, cut-out portions 53*h* through which the head-side mat surface portions 52*a* and 52*c* are allowed to pass in the bed longitudinal direction are formed on a head-side base plate 53*g* fixed to the head-side base portion 53*a* on the head-side end of the fixed portion 11 (see FIG. 1D); thus, each of the head-side mat surface portions 52*a* and 52*c* is allowed to pass through the cut-out portion 53*h*, so as to be smoothly moved from the bed formation position to the retreated position or from the retreated position to the bed formation position.

Instead of the above-mentioned structure, a hook 77 may be provided to the foot-side mat surface portion 52*b* or 52*d*, and this hook 77 in a state of being hooked with the cart portion 54 (on the rear side of the thigh resting portion 13*e* of the moving portion 12 (the wheel chair)) is pressed or pulled so that, upon joining and separating the moving portion 12 to and from the fixed portion 11, the foot-side mat surface portion 52*b* or 52*d* may be pulled by the cart portion 54 to be moved along the foot-side guide rail 99. In other words, in the case where the moving portion 12 gets out of the concave portion 89 of the fixed portion 11, the hook 77 is hooked with the cart portion 54, and along with the outward movement of the cart portion 54, the foot-side mat surface portion 52*b* or 52*d* may be moved from the bed formation position to the retreated position along the foot-side guide rail 99. In contrast, in the case where the moving portion 12 is inserted into the concave portion 89 of the fixed portion 11 from the outside of the concave portion 89, the hook 77 is hooked with the cart portion 54, and along with the movement of the cart portion 54 into the concave portion 89, the foot-side mat surface portion 52*b* or 52*d* may be moved from the retreated position to the bed formation position along the foot-side guide rail 99.

With this structure, when the moving portion 12 is separated from the fixed portion 11 of the movable bed 10 and when the moving portion 12 is joined to the fixed portion 11 thereof, the movable mat portion 52 of the moving portion 12 departs from the moving portion 12 in association with the movement of the moving portion 12, so that no physical interference is applied from the fixed portion 11 to the moving portion 12. Therefore, the moving portion 12 can be smoothly and swiftly separated from the fixed portion 11 of the movable bed 10 and returned (joined) to the fixed portion 11.

Moreover, the movable mat portion 52 includes at least the head-side mat surface portion 52*a* and the foot-side mat surface portion 52*b*, and is designed such that the head-side mat surface portion 52*a* is allowed to move from the center toward the head side (that is, from the close position to the separated position side) and the foot-side mat surface portion 52*b* is allowed to move from the center toward the foot side on the side (that is, from the close position to the separated position side).

With this structure, it is possible to eliminate a physical interference of the head-side mat surface portion 52*a* of the fixed portion 11 with the back raised portion of the back resting portion 13*b* of the moving portion 12 as well as a physical interference of the foot-side mat surface portion 52*b* of the fixed portion 11 with the leg raised portion of the leg resting portion 13*f*. That is, when the moving portion 12 is separated from the fixed portion 11, the foot-side mat surface portion 52*b* or 52*d* of the fixed portion 11 departs from the armrest portion 14*a* or 14*c* of the moving portion 12 diagonally outward and is rotated in a manner so as to be bent along the vertical direction by the rotation hinge 88 on the outer end of the foot-side guide rail 99 so as to be positioned on the separated position (the retreated position indicated by the chain line in FIG. 1E) on the far side. With this layout, even when the leg resting portion 13*f* of the moving portion 12 is moved in the width direction of the fixed portion 11 simply in parallel therewith, it is prevented from being made in contact with the foot-side mat surface portion 52*b* or 52*d* of the fixed portion 11. Therefore, the leg raised amount for eliminating the physical interference in the leg resting portion 13*f* of the moving portion 12 can be minimized, so that the moving portion 12 can be separated from or joined to the fixed portion 11 while maintaining an appropriate sitting posture state. In other words, since the leg raised amount for eliminating the physical interference in the leg resting portion 13*f* of the moving portion 12 can be minimized, the person 15 sitting on the moving portion 12 needs not to have a largely increase leg raised amount from the lying posture state, and needs not to take an unstable posture such as a posture with the legs being raised greatly. Therefore, the person 15 is allowed to move on the moving portion 12 safely in a stable posture.

With respect to the specific movement of the head-side mat surface portion 52*a* of the fixed portion 11, there are two kinds of movements, namely, sliding diagonally to be folded (bend downward) as shown in FIG. 1B, and sliding upward (move planarly) as shown in FIG. 3. In the specific explanation, FIGS. 1E and 1D show the moving structure of sliding upward shown in FIG. 3. Moreover, with respect to the specific movement of the foot-side mat surface portion 52*b* or 52*d*, there is a movement, as shown in FIGS. 1B and 3 as well as in FIGS. 1E and 1D in the specific explanation as described above, of sliding diagonally to be folded (bend downward). That is, it means that the foot-side mat surface portion 52*b* or 52*d* is moved along a single or a pair of second foot-side guide rails 99A as shown in FIG. 1B as one example of a second foot-side guide member that extends in a direction departing from the armrest portion 14*a* or 14*c* (in other words, in a direction diagonally outward with respect to the direction along the height of the person 15 (the bed longitudinal direction)), and also is moved so as to be bent and rotated to be positioned at the separated position on the far side, so that the surface forming the mat surface is positioned in the vertical direction, by a rotation hinge 88B (corresponding to the rotation hinge 88 in FIG. 1D) as one example of a rotation coupling member on the outer end of the second foot-side guide rail 99A.

Figure 6:
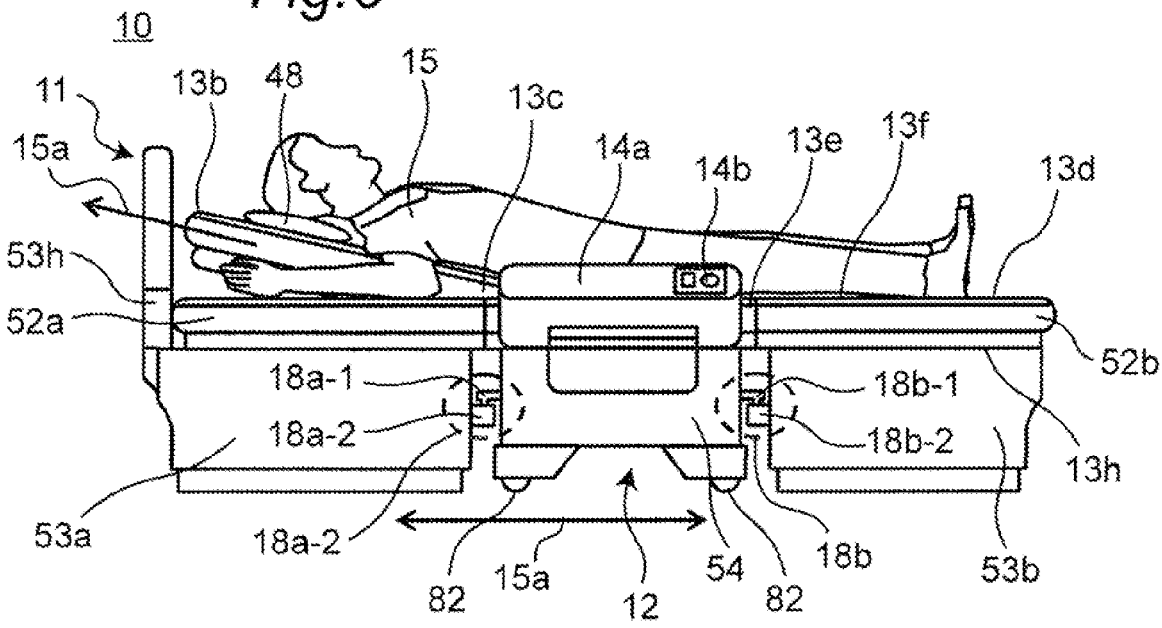
FIG. 6 is a side view that shows a state where, on the movable bed according to the first embodiment of the present invention, the moving portion is about to change from the lying posture state to the back-raised and leg-raised posture state.
Figure 7:
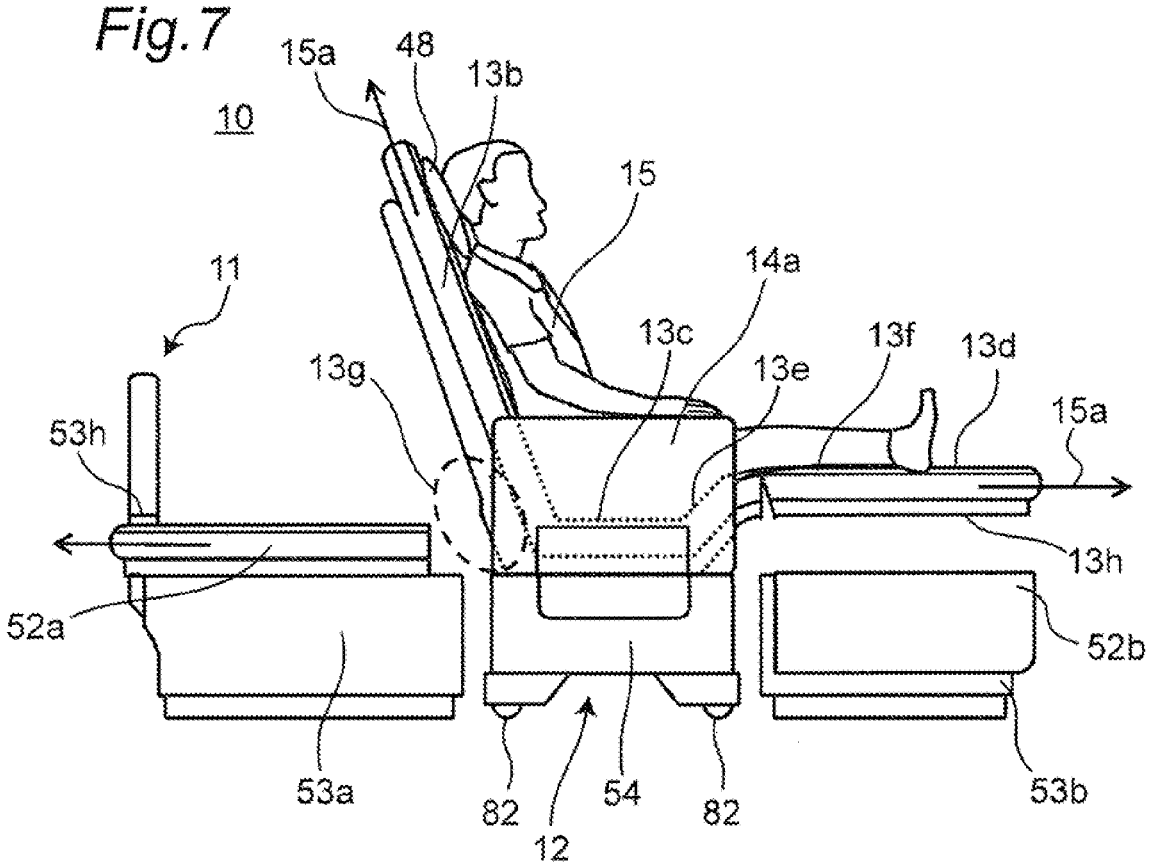
FIG. 7 is a side view that shows a state where, on the movable bed according to the first embodiment of the present invention, after the moving portion has been changed into the back-raised and leg-raised posture state, the moving portion is being separated from the fixed portion toward the front side.

Only the head-side mat surface portion 52*a* has two kinds of moving methods because the head-side mat surface portion 52*a* is sometimes moved in two posture states, namely, the lying posture state and the back-raised and leg-raised posture state. In the specific movements of the head-side mat surface portion 52*a*, the movement of sliding diagonally and folded as shown in FIG. 1B refers to a movement same as the movement in which the foot-side mat surface portion 52*b* or 52*d* departs diagonally outward from the armrest portion 14*a* or 14*c* and is also rotated in a manner so as to be bent along the vertical direction by the rotation hinge 88 on the outer end of the foot-side guide rail 99 so as to be placed on the separated position on the far side. FIGS. 6 and 7 are side views that show states, viewed from the side 17*a*, where, by driving the rotation driving source 51M under the control of the control device 100, the moving portion 12 is transformed from the lying posture state into the back-raised and leg-raised posture state. FIG. 6 is the side view that shows a state where, by driving the rotation driving source 51M under the control of the control device 100, the moving portion 12 is about to be transformed from the lying posture state into the back-raised and leg-raised posture state. FIG. 7 is the side view that shows a state where, by driving the rotation driving source 51M and the wheel driving source 81 under the control of the control device 100, the moving portion 12 is transformed into the back-raised and leg-raised posture state and then the moving portion 12 is being separated from the fixed portion 11 toward the front side.

FIG. 6 shows the state where the person 15 riding on the moving portion 12 is changed from the lying posture state to the back-raised and leg-raised posture state by the rotational rise of the back resting portion 13*b* (a clockwise rotation operation in FIG. 6) and the rotational rise of the thigh resting portion 13*e* (an anticlockwise rotation operation in FIG. 6).

Moreover, FIG. 6 also shows that the armrest portions 14*a* and 14*c*, having formed parts of the mat portion 51, are rotated and raised to the sides of the person 15 (pivoted from the sideway lying posture state to the upright posture state) so as to be transformed into the armrest portions of the wheel chair. At this time, the mat surface of at least any one of the back resting portion 13*b* and the leg resting portion 13*f* of the moving portion 12 is designed to slide in the body trunk direction 15*a* of the person 15 in accordance with the transformation of the posture state of the moving portion 12. As one example of a sliding mechanism in which the back resting portion 13*b* slides in the body trunk direction 15*a* of the person 15, a known direct-driven slider 61 may be installed in the back resting portion 13*b* so that a mattress on the surface of the back resting portion 13*b* is direct-driven and moved by the direct-driven slider 61 in accordance with the transformation of the posture states of the fixed portion and the moving portion 12 in order to allow the back resting portion 13*b* to slide. In the same manner, as one example of a sliding mechanism in which the leg resting portion 13*f* slides in the body trunk direction 15*a* of the person 15, a known direct-driven slider 62 may be installed in the leg resting portion 13*f* so that a mattress on the surface of the leg resting portion 13*f* is direct-driven and moved by the direct-driven slider 62 in accordance with the transformation of the posture states of the fixed portion 11 and the moving portion 12 in order to allow the leg resting portion 13*f* to slide. With these structures, deviations between the body of the person 15 and the mat surface due to raising and lowering movements of the back resting portion 13*b* and the leg resting portion 13*f* of the moving portion 12 can be reduced. Since any stress is hardly applied to any portions of the movable bed 10 by the raising and lowering movements, it is possible to realize the movable bed 10 with high reliability.

FIG. 7 shows a state where the person 15 is riding on the moving portion 12 in the back-raised and leg-raised posture state, and the moving portion 12 is passing immediately above the bed base portion 53 of the fixed portion 11 and separated from the fixed portion 11 in the width direction of the fixed portion 11 (toward the front side in the penetrating direction with respect to the drawing surface of FIG. 7). Therefore, it is only necessary for lower surfaces 13*h* of the leg resting portion 13*f* and the foot resting portion 13*d* of the moving portion 12 to be depart above from the foot-side base portion 53*b* in such a degree as not to be made in contact with the foot-side base portion 53*b* of the fixed portion 11. In this back-raised and leg-raised posture state, it is possible to reduce load due to the leg-raised posture to be applied to the person riding on the moving portion 12. Moreover, in the case where the moving portion 12 is being separated from the fixed portion 11 in the back-raised and leg-raised posture state, in accordance with the moving operation, ahead of the moving portion 12, the movable mat portion 52 of the fixed portion 11 is allowed to slide on the guide rail 97 of the head-side base portion 53*a* and move from the close position to the separated position, so as to be placed on the separated position of the side portion of the fixed portion 11 as shown in FIG. 7.

Moreover, at this time, the mat surface of at least any one of the movable mat portion 52 of the fixed portion 11 as well as the back resting portion 13*b* and the leg resting portion 13*f* of the moving portion 12 is designed to slide in the body trunk direction 15*a* of the person 15 in accordance with the transformations of the posture states of the fixed portion 11 and the moving portion 12.

With this structure, it is possible to reduce deviations between the mat surface and the body of the person 15 due to the raising and lowering operations of the back resting portion 13*b* and the leg resting portion 13*f* of the moving portion 12, and since it is also possible to prevent any portion of the bed from deviating, the movable bed 10 with high reliability can be realized. Moreover, since the head-side mat surface portion 52*a* has been moved from the center toward the head side (that is, from the close position to the separated portion), it is possible to preliminarily prevent a problem such as a failure in separating a bottom portion 13*g* of the back sitting portion 13*b* to the front side due to a collision with the head-side mat surface portion 52*a*, even when the back resting portion 13*b* is placed at a normal diagonal position in the back-raised and leg-raised posture state.

As shown in FIG. 6, in the case where the moving portion 12 is fixed to the fixed portion 11, for example, the moving portion 12 and the fixed portion 11 are coupled and fixed to each other, by coupling units 18*a* and 18*b* or the like, for example, as shown in FIG. 6. The coupling units 18*a* and 18*b* are configured by lock pins 18*a*-1 and 18*b*-1 that are respectively coupled to a lock pin driving device 18A such as a solenoid or a cylinder disposed in the cart portion 54 of the moving portion 12, and lock members 18*a*-2 and 18*b*-2 that are respectively coupled to the lock member driving devices 18B such as solenoids or cylinders respectively disposed in the head-side base portion 53*a* and the foot-side base portion 53*b* of the fixed portion 11, and are also respectively provided with lock holes or concave portions to be engaged with the lock pin 18*a*-1 and 18*b*-1. In the case where, after the moving portion 12 and the fixed portion 11 have been joined to each other, the coupling units 18*a* and 18*b* carry out coupling operations so as to maintain the joined state, the lock pin driving devices 18A are driven so that the lock pins 18*a*-1 and 18*b*-1 protrude from the inside of the cart portion 54 of the moving portion 12, while the lock member driving devices 18B are also driven so that the lock members 18*a*-2 and 18*b*-2 protrude from the insides of the head-side base portion 53*a* and the foot-side base portion 53*b* of the fixed portion 11, and thus, the lock pins 18*a*-1 and 18*b*-1 are engaged with the lock holes or the concave portions of the lock members 18*a*-2 and 18*b*-2 so as to carry out lock operations. In contrast, in the case where the moving portion 12 is separated from the fixed portion 11, as shown in FIG. 7, the coupling operations of the coupling units 18*a* and 18*b* are released and are respectively housed in the fixed portion 11 and the moving portion 12. That is, the lock pin driving devices 18A and the lock member driving devices 18B are respectively driven so that the lock pins 18*a*-1 and 18*b*-1 are released from the engagements with the lock holes or concave portions of the lock members 18*a*-2 and 18*b*-2 to complete lock release operations, and the lock pins 18*a*-1 and 18*b*-1 are then housed in the cart portion 54 of the moving portion 12, while the lock members 18*a*-2 and 18*b*-2 are housed in the head-side base portion 53*a* and the foot-side base portion 53*b* of the fixed portion 11.

Figure 8:
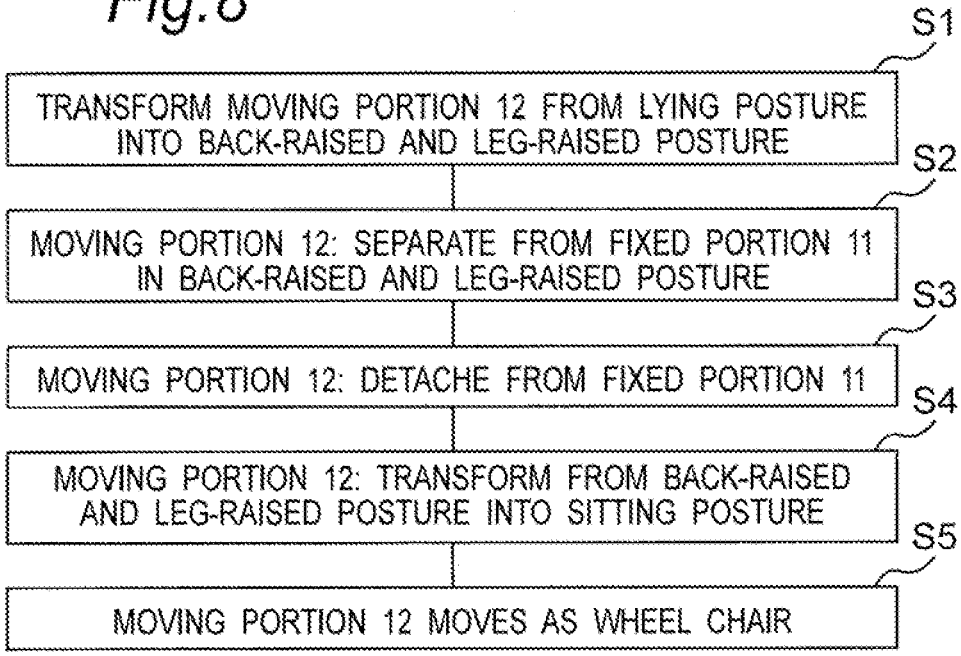
FIG. 8 shows a flow chart that schematically shows a sequence of operations by which the moving portion of the movable bed according to the first embodiment of the present invention is changed into the wheel chair state.
Figure 9:
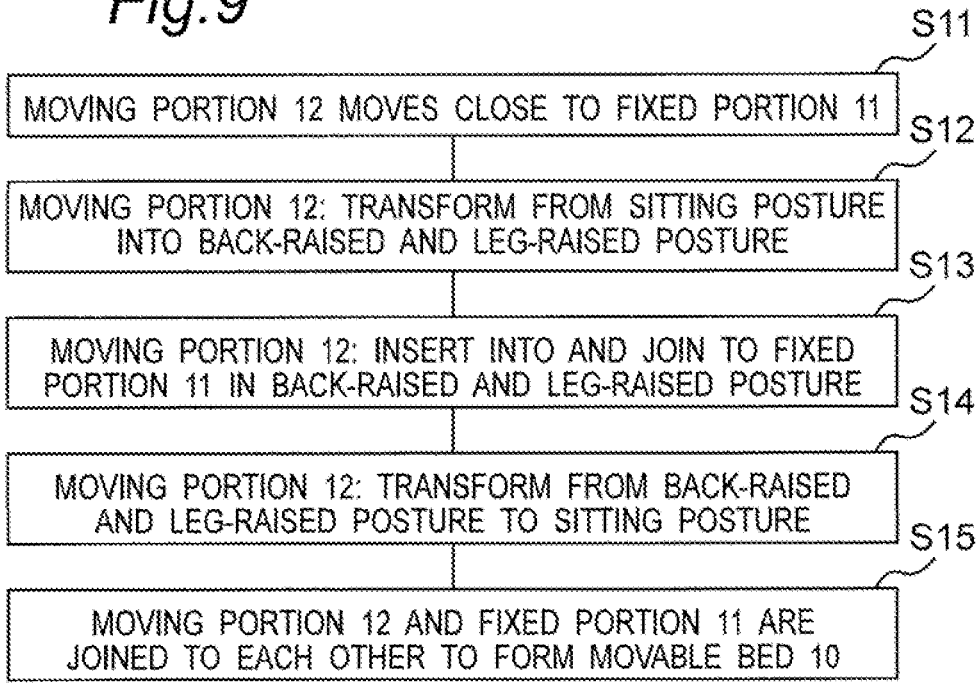
FIG. 9 shows a flow chart that schematically shows a sequence of operations by which the moving portion having been changed into the wheel chair state is joined to the fixed portion to form the movable bed in the movable bed according to the first embodiment of the present invention.

FIG. 8 is a flow chart that schematically shows the sequence of operations in which the moving portion 12 of the movable bed 10 of the first embodiment is separated from the movable bed 10 and transformed into the wheel chair state. In contrast, FIG. 9 is a flow chart that schematically shows operations in which the moving portion 12, having transformed into the wheel chair state, is joined to the fixed portion 11 to form the movable bed 10.

More specifically, as shown in FIG. 8, the moving portion 12 of the movable bed 10 is transformed into the wheel chair state through five steps, namely, steps S1 to S5.

In step S1, under the control of the control device 100, the rotation driving source 51M is driven so that, as shown in FIG. 3 or FIG. 6, the moving portion 12 is transformed from the lying posture state into the back-raised and leg-raised posture state.

In step S2, under the control of the control device 100, the rotation driving source 51M is driven so that, as shown in FIGS. 3, 4, and 7, the moving portion 12 is separated from the fixed portion 11 in the back-raised and leg-raised posture state. At this time, as shown in FIG. 7, for example, the fixed state between the moving unit 12 and the fixed portion 11 may be released through the coupling release operations carried out by the coupling units 18*a* and 18*b*.

In step S3, under the control of the control device 100, the wheel driving source 81 is driven so that, as shown in FIG. 4, the moving portion 12 is completely separated from the fixed portion 11.

In step S4, under the control of the control device 100, the rotation driving source 51M is driven so that, as shown in FIG. 5, the moving portion 12 is transformed from the back-raised and leg-raised posture state of FIG. 4 into the sitting posture state.

In step S5, under the control of the control device 100, the wheel driving source 81 is driven so that, the moving portion 12 having transformed into the wheel chair state through steps S1 to S4 moves with the person 15 carried thereon.

As shown in FIG. 9, the moving portion 12, which has been moving as the wheel chair, is joined to the fixed portion 11, with the person 15 carried thereon, and transformed into the movable bed 10 through five steps S11 to S15. These operations are carried out by a process reversed to that shown in the flow chart of FIG. 8.

In step S11, under the control of the control device 100, the wheel driving source 81 is driven so that, as shown in FIG. 5, the moving portion 12 (the wheel chair) is moved to come close to the fixed portion 11.

In step S12, under the control of the control device 100, the rotation driving source 51M is driven so that, in order to allow the moving portion 12 to be inserted in the concave portion 89 of the fixed portion 11 of the movable bed 10, the moving portion 12 is transformed from the sitting posture state of FIG. 5 into the back-raised and leg-raised posture state shown in FIG. 4.

In step S13, under the control of the control device 100, the wheel driving source 81 is driven so that, as shown in FIG. 3, the moving portion 12 is inserted in the fixed portion 11 in the back-raised and leg-raised posture state and joined thereto. At this time, as shown in FIG. 6, for example, the moving portion 12 may be firmly fixed to the fixed portion 11 through the coupling operations by the coupling units 18*a* and 18*b*.

In step S14, under the control of the control device 100, the rotation driving source 51M is driven so that, as shown in FIG. 2 or FIG. 6, the moving portion 12 is transformed from the back-raised and leg-raised posture state into the lying posture state.

In step S15, under the control of the control device 100, the rotation driving source 51M is driven so that, as shown in FIGS. 1A to 2, the moving portion 12 and the fixed portion 11 form the movable bed 10.

By successively carrying out the operations of this flow chart under the control of the control device 100, this structure can be utilized as the bed and as the wheel chair. Thus, with this structure, it is possible to swiftly carry out the separating operation or the returning operation (the joining operation) from or to the fixed portion 11 of the movable bed 10, while the person 15 such as a cared person lying thereon is safely kept in a comfortable posture with his or her back or legs being raised. Therefore, it is possible to provide the movable bed 10 that reduces load applied to a care giver, by allowing the person 15 such as the cared person to lie on the movable bed 10 comfortably and also to move on the moving portion 12 (the wheel chair) safely and comfortably. Moreover, since the bed and the wheel chair are provided integrally, there is required no storage place for the moving portion 12 (the wheel chair) when used as the movable bed 10.

Furthermore, in the first embodiment, the explanation has been given with reference to the drawings in which a pillow 48 is placed at a position of the head of the person 15; however, this pillow (head rest) 48 may be formed integrally with the back resting portion 13*b* of the moving portion 12. In this case, in order to change the respective functions between the bed state and the wheel chair state, an arrangement may be proposed in which, in the bed state, the head rest 48 is moved in a direction perpendicular to the surface of the back resting portion 13*b*, while, in contrast, in the wheel chair state, the head rest 48 is moved at a certain angle with respect to the surface of the back resting portion 13*b*. This arrangement makes it possible to provide as the pillow 48 in the bed state so as to be in parallel with the surface of the back resting portion 13*b* and to be easily used, and as the head rest 48 in the wheel chair state so as to have a certain angle with respect to the surface of the back resting portion 13*b* so as to be easily used.

Second Embodiment

FIGS. 10 to 13 are perspective views each of which schematically shows the structure of a movable bed 20 according to the second embodiment of the present invention.

Figure 10:
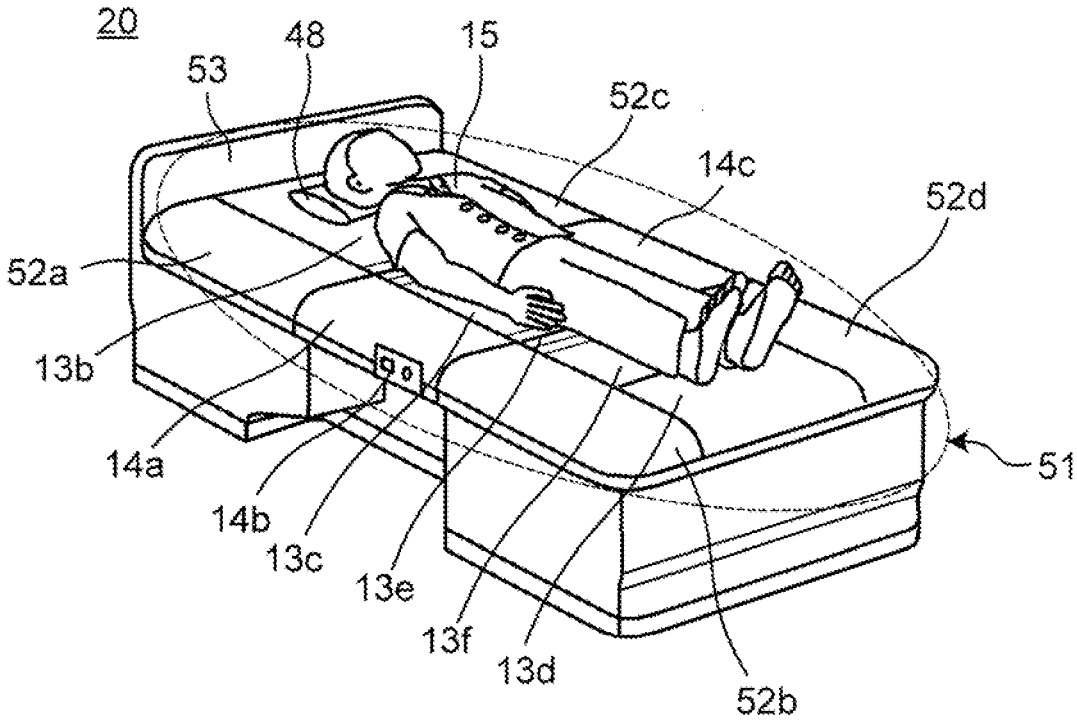
FIG. 10 is a perspective view that shows a schematic structure of a movable bed according to a second embodiment of the present invention.
Figure 13:
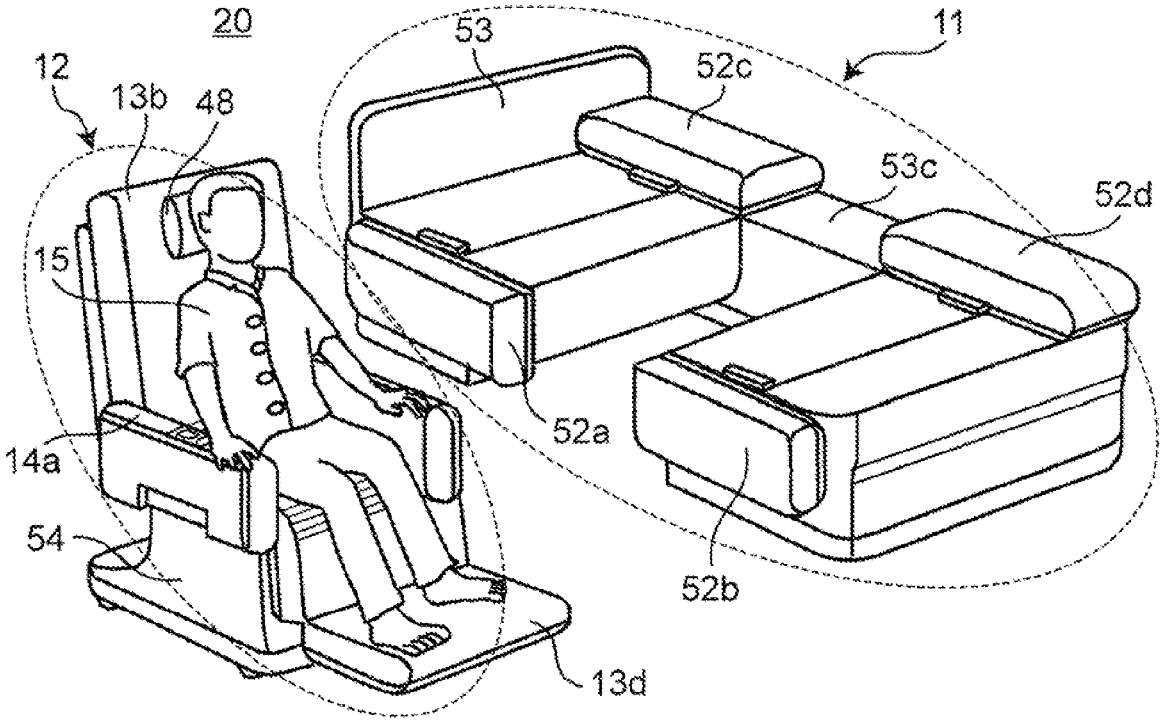
FIG. 13 is a perspective view that shows a schematic structure of the movable bed according to the second embodiment of the present invention.

As shown in FIGS. 10 and 13, in the same manner as in the movable bed 10 of the first embodiment, the movable bed 20 according to the second embodiment, is the movable bed 20 where the mat portion 51 allowing the person to lie thereon (lies about) is composed of the fixed portion 11 and the moving portion 12. The moving portion 12 of the movable bed 20 is designed as a wheel chair that can be joined or separated to or from the fixed portion 11, and can also be transformed from the lying posture state into the sitting posture state without through the back-raised and leg-raised posture state. In order to achieve this structure, when the separating operation or the joining operation is carried out between the moving portion and the fixed portion 11, under the control of the control device 100, it is designed so as to control so that the transformation may be performed between the lying posture state and the sitting posture state without through the back-raised and leg-raised posture state. When the moving portion 12 is joined to the fixing portion 11 to form the movable bed 20, the upper surface of the seat portion 13 for carrying the person 15 thereon of the moving portion 12 and inner surfaces of the armrest portions 14*a* and 14*c* are designed to form the mat surface of the mat portion 51 of the movable bed 20. In this case, the mat portion 51 corresponds to a mattress for an ordinary bed, and the mat surface thereof corresponds to the surface of the mattress on which the person 15 lies. Moreover, an operation panel (remote controller) 14*b*, which controls operations of the movable bed 20 including operations of the moving portion 12, is disposed on a side of the armrest portion 14*a*.

With this structure, the cared person 15 or the like lying thereon allows the moving portion 12 to swiftly carry out operations such as separating or returning (joining) from and to the fixed portion 11 of the bed safely while being kept in his or her comfortably lying posture. Therefore, it is possible to achieve the movable bed 20 by which the cared person 15 or the like can be comfortably lying on the movable bed 20 and can also move safely and comfortably on the wheel chair (the moving portion 12) having a shape shown in FIG. 13, without applying much load to a care giver. Moreover, since the bed and the wheel chair are provided integrally, there is required no storage place for the wheel chair when used as the bed.

Figure 11:
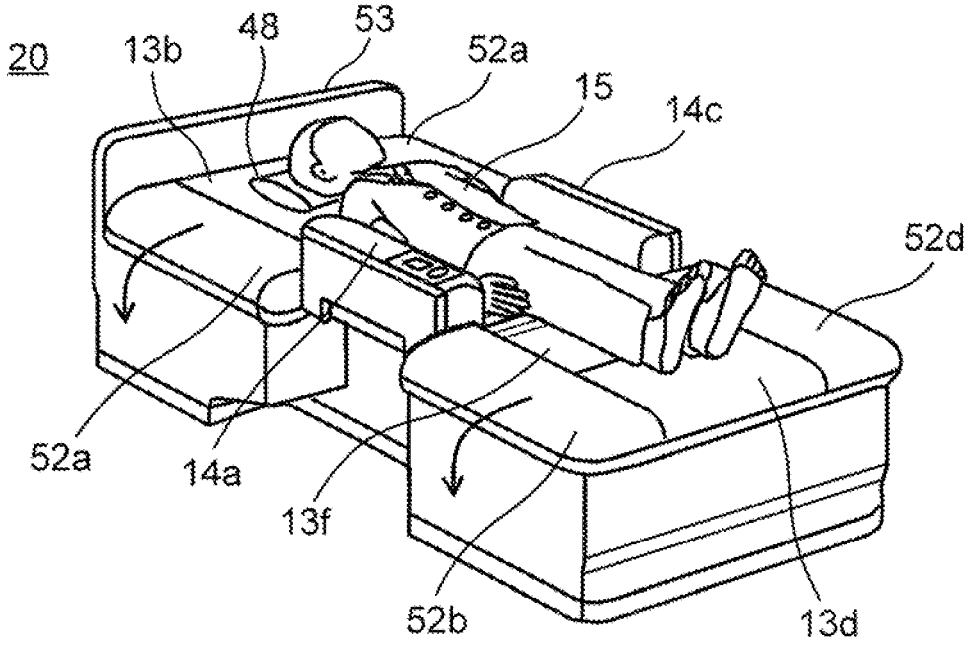
FIG. 11 is a perspective view that shows a schematic structure of the movable bed according to the second embodiment of the present invention.
Figure 12:
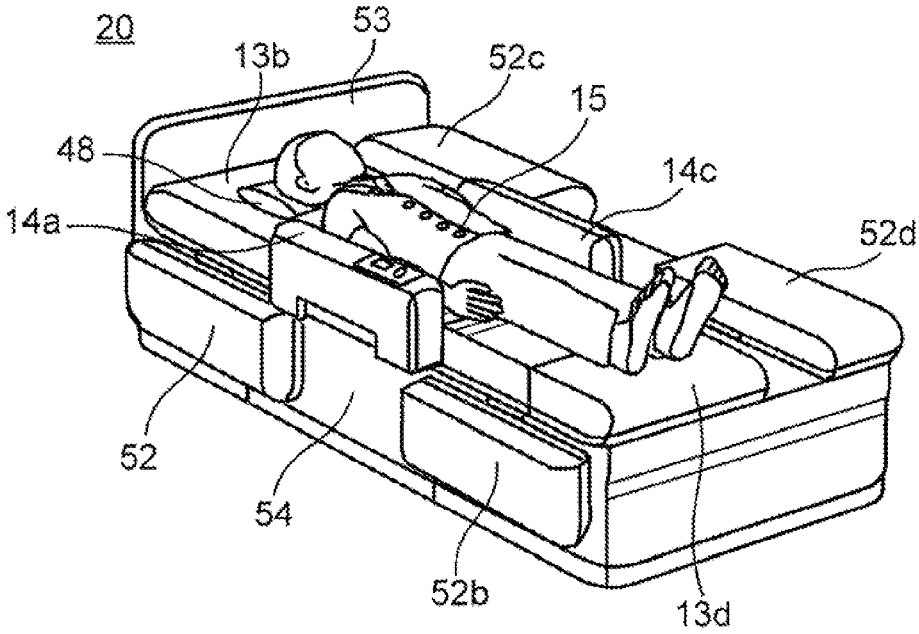
FIG. 12 is a perspective view that shows a schematic structure of the movable bed according to the second embodiment of the present invention.

The movable bed 20 of the second embodiment is different from the movable bed 10 of the first embodiment in that, as shown in FIGS. 11 and 12, under the control of the control device 100, the moving portion 12 is separated from the fixed portion 11 while being kept in the lying posture state without through the back-raised and leg-raised posture state. In this case, the head-side mat surface portion 52*a* or 52*c* is moved so as to diagonally slide and be folded, as shown in FIG. 1B of the first embodiment. That is, the head-side mat surface portion 52*a* or 52*c* is moved along a single or a pair of second head-side guide rails 97A, each of which is one example of a second head-side guide member that extends in a departing direction from the armrest portion 14*a* or 14*c* (namely, in a direction diagonally outward with respect to the direction along the height of the person 15 (the bed longitudinal direction)), and also moved so as to be bent and rotated by a rotation hinge 88A (corresponding to the rotation hinge 88 in FIG. 1D) as one example of a rotation coupling member on the outer end of the second head-side guide rail 97A, so as to be positioned at the separated position on the far side, with the surface having formed the mat surface being positioned in the vertical direction. The specific movement of the foot-side mat surface portion 52*b* or 52*d* is a movement for diagonally sliding to be folded, as shown in FIG. 1B and FIG. 3 of the first embodiment as well as in FIG. 1E and FIG. 1D in the aforementioned specific explanation. That is, the foot-side mat surface portion 52*b* or 52*d* is moved along a single or a pair of second foot-side guide rails 99A, each of which is one example of a second foot-side guide member that extends in a direction departing from the armrest portion 14*a* or 14*c* (that is, in a direction diagonally outward with respect to the direction along the height of the person 15 (the bed longitudinal direction)), and also moved so as to be bent and rotated, so as to be positioned at the separated position on the far side, with the surface having formed the mat surface being positioned in the vertical direction, by a rotation hinge 88B (corresponding to the rotation hinge 88 in FIG. 1D) as one example of a rotation coupling member on the outer end of the second foot-side guide rail 99A. Moreover, the paired armrest portions 14*a* and 14*c* are pivoted from the sideway lying posture state to the upright posture state so that in a safety ensured state with two sides of the person 15 being capable of being supported, the separating operation or the joining operation between the fixed portion 11 and the moving portion 12 is carried out while the seat portion 13 is being kept in the lying posture. The other points of the movable bed 20 are virtually the same as those of the movable bed 10, so that specific explanations of the operation will not be provided repeatedly. Thus, the moving portion 12 may be moved as the wheel chair still in the lying posture state, without applying more load to the person 15.

Moreover, in the movable bed 20, in order to separate the moving portion 12 from the fixed portion 11 while being kept in the lying posture state, it is designed so that the movable mat portions 52*a* and 52*b* shown in FIG. 11 are moved in directions of arrows and moved along the side portions of the movable bed 20 as shown in FIGS. 12 and 13. In this manner, the moving portion 12 is separated from the movable bed 20 while being kept in the lying posture state, and is then transformed into the sitting posture state so that the wheel chair in the sitting posture state is formed and moved.

Third Embodiment

FIG. 14 is a perspective view that schematically shows a structure of a movable bed 30 according to the third embodiment of the present invention. In the same manner as in the movable beds 10 and 20 of the first and second embodiments, the moving portion 12 of the movable bed 30 according to the third embodiment is designed so as to be separated from the fixed portion 11 or joined to the fixed portion 11 to form a wheel chair that can be transformed from the lying posture state to the sitting posture state.

However, different from the movable beds 10 and 20 of the first and second embodiments, in the movable bed 30 of the third embodiment, when the fixed portion 11 and the moving portion 12 are joined together, under the control of the control device 100, among a plurality of divided portion driving units 31 each including a back portion driving unit 31*a* and a leg portion driving unit 31*b* provided to either one of the fixed portion 11 and the moving portion 12, and a lift driving unit 32, at least either one of the driving units 31 and 32 is driven in association with the other. In this manner, since either one of the driving units 31 and 32 is driven in association with the other under the control of the control device 100, the movable bed 30 is allowed to carry out at least any one of operations, such as a back-raising operation, a leg-raising operation, a lifting or lowering operation and the like, with respect to the entire mat surface of the mat portion 51 of the bed 30. The reason why at least either one of the driving units 31 and 32 is driven in association with the other is because, by operating integrally the mat surface composed of the moving portion 12 and the fixed portion 11, the mat surface is allowed to function as a mat surface similar to that of an ordinary caring bed. In this case, the lifting and lowering operations mean upward and downward movements of the mat surface. The purpose of lifting and lowering operations is to assist a caring job or a riding movement. As the structure of the lift driving unit 32 for this purpose, for example, by using a known link mechanism or the like installed in the cart portion 54, the mat surface is lifted and lowered by using a motor as one example of a driving source, through the link mechanism. The driving source of the divided portion driving units 31 (the back portion driving unit 31*a* and the leg portion driving unit 31*b*) and the lift driving units 32 is, for example, provided as a single or a plurality of motors or the like, similarly to the rotation driving source 51M.

Moreover, another structure may be used in which, when the fixed portion 11 and the moving portion 12 are joined together, under the control of the control device 100, among the plurality of divided portion driving units 31 and the lift driving units 32 respectively provided to the fixed portion 11 and the moving portion 12, at least either one of the paired driving units 31 and 32 is driven in synchronism with each other, so that the movable bed 30 is allowed to carry out at least any one of the operations, such as the back-raising operation, the leg-raising operation, the lifting or lowering operation and the like, with respect to the entire mat surface of the mat portion 51 of the bed.

With this structure, since the entire mat surface of the movable bed 30 can be moved, it is possible to carry out the transformation in the posture states comfortably as the bed in the same manner as in an ordinary bed.

Moreover, as shown in FIG. 14, the mat surface of at least any one of the movable mat portion 52 of the fixed portion 11 as well as the back resting portion 13*b* and the leg resting portion 13*f* of the moving portion 12 is allowed to slide in the body trunk direction 15*a* of the person indicated by the arrow, in accordance with the transformations in the posture states of the fixed portion 11 and the moving portion 12.

With this structure, deviations between the body of the person 15 and the mat surface of the movable bed 30 due to the raising and lowering movements of the back resting portion 13*b* and the leg resting portion 13*f* of the moving portion 12 can be reduced, and since any deviations hardly occur as the bed, it is possible to realize the movable bed 30 with high reliability. FIG. 14 shows an example in which the head-side mat surface portions 52*a* and 52*c* are shown as the head-side mat surface portions 55*a* and 55*c* fixed integrally not to the fixed portion but to the back resting portion 13*b* of the moving portion 12. In this example, the head-side mat surface portions 55*a* and 55*c* are moved by the moving portion 12 together with the back resting portion 13*b*.

Figure 15B:
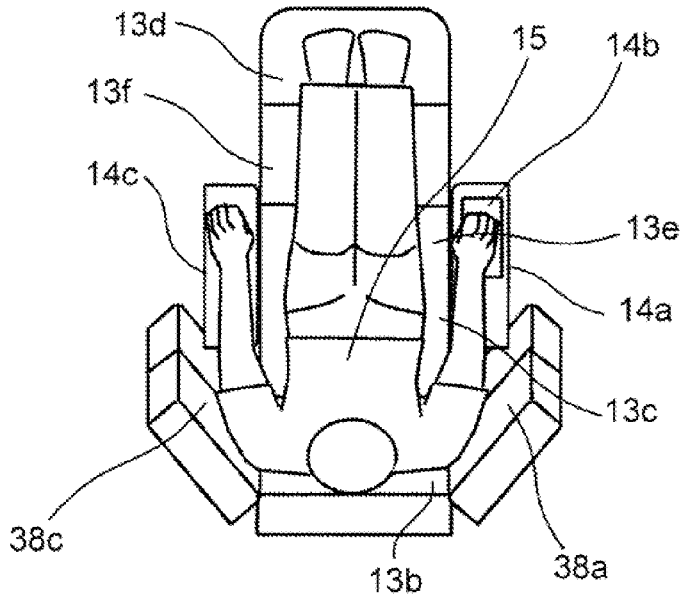
FIG. 15B is a perspective view that shows a schematic structure of the movable bed according to the third embodiment of the present invention, and that corresponds to a front view showing the periphery of the person viewed in an arrow direction of FIG. 15A.
Figure 16:
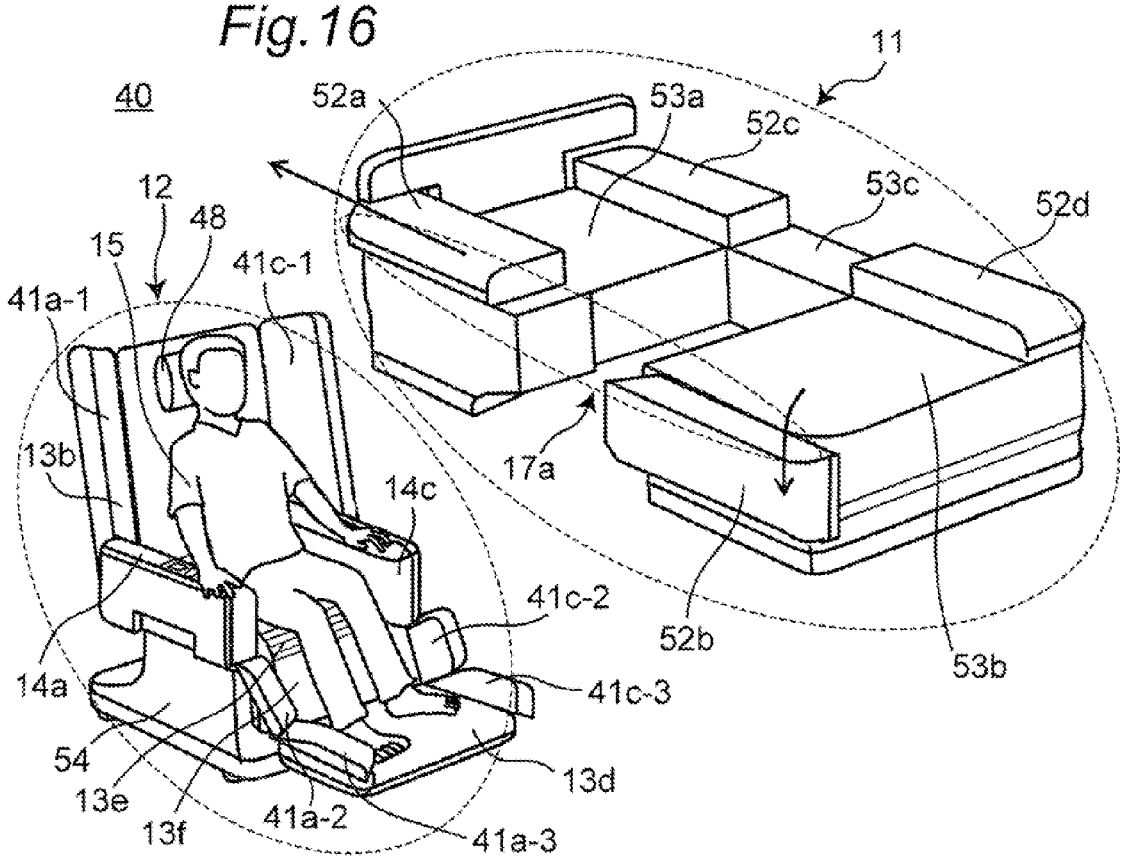
FIG. 16 is a perspective view that shows a schematic structure of the movable bed according to the third embodiment of the present invention.
Figure 17:
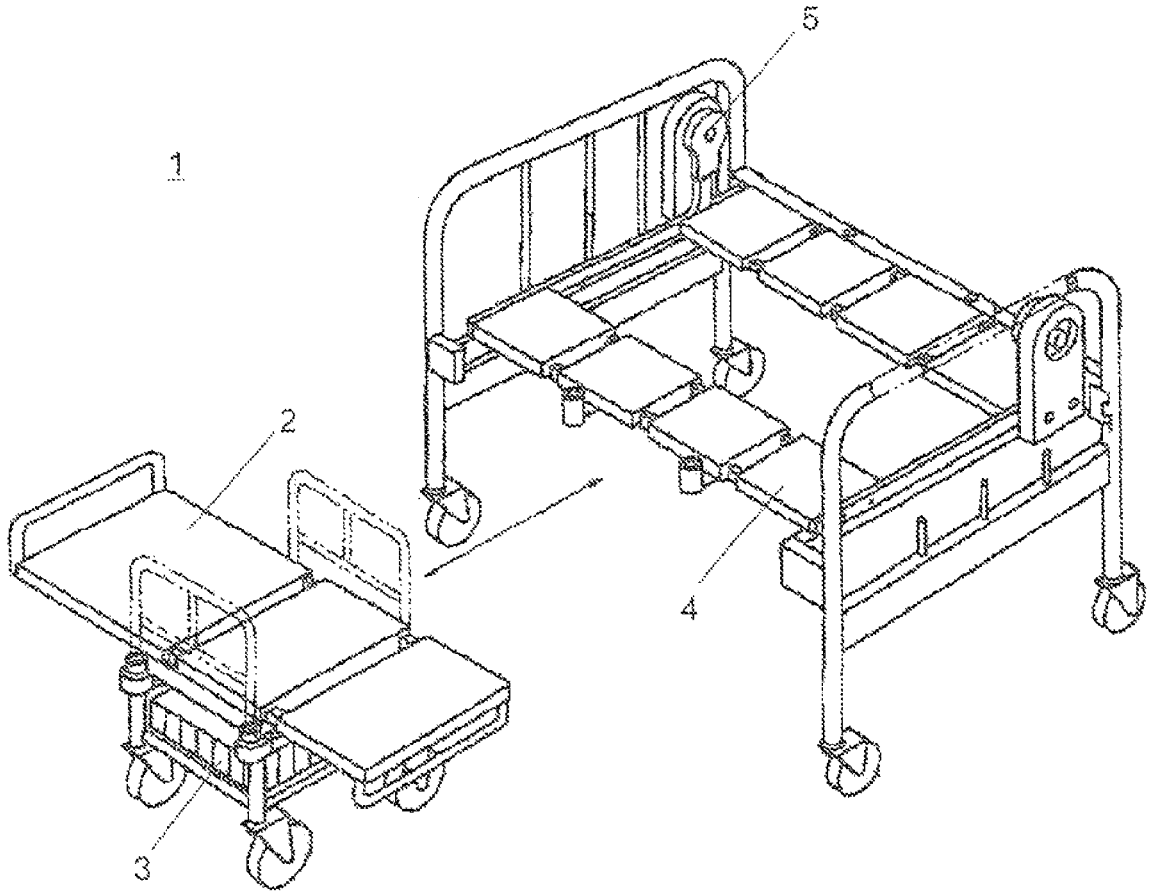
FIG. 17 is a perspective view that shows a schematic structure of a bed apparatus according to Patent Document 1.

FIGS. 15A and 15B, as well as FIG. 16, are perspective views that show schematic structures of movable beds 35 and 40 according to the third embodiment of the present invention. FIG. 15A is the perspective view that shows a state where side portions of the moving portion 12 are disposed on the movable mat portion 52 of the fixed portion 11 in a manner so as to be adjacent with one another and are surround side portions of the person 15. FIG. 15B is a front view showing the periphery of the person 15, viewed in a direction of an arrow 37 of FIG. 15A. Different from the movable beds 10 and 20 of the first and second embodiments, the movable beds 35 and 40 of the third embodiment each have side portions for prevention of the falling which are formed to surround the person 15.

As shown in FIGS. 15A and 15B, the mat portion 51 of the movable bed 35 is provided with side mat portions 38*a* and 38*c* on two sides thereof, as one example of side portions for the falling prevention, and each of the side mat portions 38*a* and 38*c* is divided into a plurality of portions in the direction along the height of the person 15 (the bed longitudinal direction). As shown in FIG. 15, rotary shafts 47*a* and 47*c* are disposed on border portions between each of the side mat portions 38*a* and 38*c* and the back resting portion 13*b* so as to rotate positively/negatively along rotation center axes of bending operations. Each of the rotary shafts 47*a* and 47*c* is coupled to one or a plurality of rotation driving sources 51M, such as motors, and, for example, encoders 78*a* and 78*c* (see FIG. 1G), which are connected to the control device 100, are provided to the respective rotary shafts 47*a* and 47*c*. Thus, the rotation angles of the respective rotary shafts 47*a* and 47*c*, detected by the encoders 78*a* and 78*c*, are inputted to the control device 100, and based upon the controlling operations of the control device 100, the rotation driving source 51M drives the positive/negative rotations of the rotary shafts 47*a* and 47*c* so that the side mat portions 38*a* and 38*c* are rotated to the person 15 side with respect to the back resting portion 13*b*, or rotated in the reversed direction (pivoted from the sideway lying posture state to the upright posture state, or in contrast, from the upright posture state to the sideway lying posture state).

The side mat portions 38*a* and 38*c*, shown in FIGS. 15A and 15B, are disposed to be divided into two in the direction along the back of the person 15, and may be placed also on the two sides of each of the thigh resting portion 13*e*, leg resting portion 13*f*, and foot resting portion 13*d*, if necessary.

Moreover, by driving the rotation driving source 51M under the control of the control device 100, when a plurality of divided portions 13*b*, 13*c*, 13*d*, 13*e*, and 13*f* are bent with respect to each other and the bed is brought into at least any one of the lying posture state, the sitting posture state, and the leg raised posture state, it is designed that the side mat portions 38*a* and 38*c* are pivoted into the upright posture state so as to be transformed to surround the side portions of the person 15.

With this structure, since the mat portion 51 of the movable bed 35 is transformed so as to surround the side portions of the person 15 with the side mat portions 38*a* and 38*c*, when operated with the person 15 carried thereon, the person 15 is allowed to easily keep his or her posture, and preventing the person from falling down, and consequently ensuring safe movements.

FIG. 16 shows a state where side resting portions 41*a*-1, 41*a*-2, 41*a*-3, 41*c*-1, 41*c*-2, and 41*c*-3 are disposed so as to be adjacent with one another over the entire side portion of the seat portion 13 of the moving portion 12 transformed into the wheel chair state, and the side portions of the person 15 are surrounded by the side resting portions 41*a*-1, 41*a*-2, 41*a*-3, 41*c*-1, 41*c*-2, and 41*c*-3.

More specifically, as shown in FIG. 16, the seat portion 13 of the moving portion 12 (provided with the back resting portion 13*b*, the thigh resting portion 13*e*, the leg resting portion 13*f*, and the foot resting portion 13*d*) is further provided with the side resting portions 41*a*-1, 41*a*-2, 41*a*-3, 41*c*-1, 41*c*-2, and 41*c*-3 on both sides thereof, so that the side resting portions 41*a*-1, 41*a*-2, 41*a*-3, 41*c*-1, 41*c*-2, and 41*c*-3 are placed in the direction along the height of the person 15 (the bed longitudinal direction) in a manner so as to be divided into a plurality of portions. When at least any one of states among the lying posture state, the sitting posture state, and the leg-raised posture state is formed by driving the rotation driving source 51M under the control of the control device 100 so as to bend the plurality divided portions 13*b*, 13*c*, 13*d*, 13*e*, and 13*f* with respect to each other, the side resting portions 41*a*-1, 41*a*-2, 41*a*-3, 41*c*-1, 41*c*-2, and 41*c*-3 are pivoted to the upright posture state to be transformed so as to surround the person 15.

With this structure, when operated with the person 15 carried thereon, the moving portion 12 is transformed so as to allow the side resting portions 41*a*-1, 41*a*-2, 41*a*-3, 41*c*-1, 41*c*-2, and 41*c*-3 to surround the side portions of the person 15; therefore, the posture of the person 15 is easily maintained, and it is possible to prevent the person 15 from falling down, thereby ensuring safe movements.

By properly combining the arbitrary embodiments of the aforementioned various embodiments, the effects possessed by the embodiments can be produced.

The bed according to the present invention makes it possible to safely and swiftly carry out the separating operation or the returning operation from or to the fixed portion of the bed, while the person, such as a cared person, lying thereon is kept in a comfortable posture with his or her back or legs being raised. Moreover, since no storage place is required for the wheel chair when used as the bed and a high degree of flexibility is obtained in the layout of the bed in a room, the bed of the present invention is readily utilized in hospitals, homes, or the like, effectively.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A movable bed comprising:

a fixed portion; and a moving portion that is separably joined to the fixed portion, the fixed portion and the moving portion being formed into a mat portion on which a person can lie, wherein the moving portion is constructed as a wheel chair having a seat portion and an armrest portion placed on one side of the seat portion so as to be pivotable between an upright posture state and a sideway lying posture state;

in a state where the moving portion is joined to the fixed portion, the armrest portion of the moving portion is pivoted to the sideway lying posture state so that an upper surface of the seat portion and an upper surface of the armrest portion are formed into a mat surface of the mat portion; and in a state where the moving portion is separated from the fixed portion, the armrest portion of the moving portion is pivoted to the upright posture state so that the armrest portion forms an armrest of the wheel chair.

2. The movable bed according to claim 1, wherein the seat portion of the moving portion is formed by coupling a plurality of divided portions including at least a back resting portion, a hip resting portion, and a leg resting portion, to each other so as to be freely bent with respect to each other, so that, by bending the divided portions with respect to each other or by releasing bending of the divided portions with respect to each other, at least one of posture states including a lying posture state, a sitting posture state, and a leg raised posture state is formed, with the armrest portion being placed on the side of the hip resting portion so as to be pivotable.

3. The movable bed according to claim 1, wherein the moving portion is separably joined to a concave portion of the fixed portion, a movable mat portion formed by a plurality of mat surface portions is placed on at least one side of the concave portion of the fixed portion, and at least one of the plurality of mat surface portions is placed at a bed formation position to form a mat surface of the mat portion when the seat portion of the moving portion is brought into the lying posture state, while, when the moving portion is separated from or joined to the fixed portion, the movable mat portion is placed at a retreated position.

4. The movable bed according to claim 3, wherein the plurality of mat surface portions, placed on at least one of the sides of the concave portion of the fixed portion, are composed of a head-side mat surface portion placed on a head side of a person on the moving portion and a foot-side mat surface portion placed on a foot side of the person on the moving portion, and, with either one of the head-side mat surface portion and the foot-side mat surface portion being moved to the retreated position, the moving portion is moved in a width direction of the fixed portion between the head-side mat surface portion and the foot-side mat surface portion so as to be separated from or joined to the fixed portion.

5. The movable bed according to claim 3, wherein an upper surface of the seat portion of the moving portion is positioned in a center of the mat surface of the mat portion.

6. The movable bed according to claim 3, wherein the seat portion of the moving portion further includes a thigh resting portion and a foot resting portion, and when the moving portion is separated from or joined to the fixed portion, at least one of upper surfaces of a back resting portion, a leg resting portion, and the foot resting portion is placed above the upper surface of the hip resting portion in a vertical direction.

7. The movable bed according to claim 3, further comprising:

a driving unit that drives the movable mat portion so that, upon separating the moving portion from the fixed portion, the mat surface of the movable mat portion is moved in association with a separating operation of the moving portion toward a far side with respect to the moving portion, while, upon joining the moving portion to the fixed portion, the mat surface of the movable mat portion is moved in association with a joining operation of the moving portion toward a close side.

8. The movable bed according to claim 7, wherein the movable mat portion includes at least a head-side mat surface portion and a foot-side mat surface portion, and the driving unit drives the movable mat portion so that the head-side mat surface portion is moved from a center toward a head side and the foot-side mat surface portion is moved from the center toward a foot side at the side.

9. The movable bed according to claim 6, further comprising:

a slide driving mechanism that allows at least one of the mat surfaces of the back resting portion and the leg resting portion of the moving portion to slide in accordance with transformation in the posture state of the moving portion.

10. The movable bed according to claim 6, wherein among a plurality of divided portion driving units and a lift driving unit respectively provided to one of the fixed portion or the moving portion, at least one of the driving units is driven in association with another driving unit so that the movable bed is allowed to carry out at least one of operations including a back-raising operation, a leg-raising operation, and a lifting or lowering operation, with respect to an entire mat surface of the mat portions of the movable bed.

11. The movable bed according to claim 6, wherein among back driving units, leg driving units, and lift driving units respectively provided to the fixed portion and the moving portion, at least one of the paired driving units are driven in synchronism with each other so that the movable bed is allowed to carry out at least one of operations including a back-raising operation, a leg-raising operation, and a lifting or lowering operation, with respect to an entire mat surface of the mat portions of the movable bed.

12. The movable bed according to claim 11, further comprising:

a slide mechanism that allows at least one of the mat surfaces of the movable mat portion of the fixed portion as well as the back resting portion and the leg resting portion of the moving portion to slide, in accordance with transformation in the posture states of the fixed portion and the moving portion.

13. The movable bed according to claim 2, wherein the seat portion of the moving portion is provided with side resting portions on two sides thereof so that, when at least any one of states including the lying posture state, the sitting posture state, and the leg-raised posture state is formed by allowing the plurality of divided portions of the seat portion to be bent with respect to each other, the side resting portions are transformed so as to surround at least one of the back resting portion and the leg resting portion.

* * * * *